US011072176B2

(12) United States Patent
Nakayama et al.

(10) Patent No.: US 11,072,176 B2
(45) Date of Patent: Jul. 27, 2021

(54) LIQUID JET HEAD CHIP, LIQUID JET HEAD, LIQUID JET RECORDING DEVICE, AND METHOD OF FORMING LIQUID JET HEAD CHIP

(71) Applicant: SII Printek Inc., Chiba (JP)

(72) Inventors: Hitoshi Nakayama, Chiba (JP); Yuji Nakamura, Chiba (JP); Yuki Yamamura, Chiba (JP); Mizuki Kudo, Chiba (JP)

(73) Assignee: SII PRINTEK INC., Chiba (JP)

( * ) Notice: Subject to any disclaimer, the term of this patent is extended or adjusted under 35 U.S.C. 154(b) by 0 days.

(21) Appl. No.: 16/675,608

(22) Filed: Nov. 6, 2019

(65) Prior Publication Data

US 2020/0147967 A1 May 14, 2020

(30) Foreign Application Priority Data

Nov. 9, 2018 (JP) ..... JP2018-211472

(51) Int. Cl.
*B41J 2/16* (2006.01)
*B41J 2/14* (2006.01)
*B41J 2/165* (2006.01)

(52) U.S. Cl.
CPC ..... *B41J 2/1621* (2013.01); *B41J 2/14209* (2013.01); *B41J 2/14233* (2013.01); *B41J 2/16505* (2013.01)

(58) Field of Classification Search
CPC .. B41J 2/1621; B41J 2/14209; B41J 2/14233; B41J 2/16505; B41J 2/175; B41J 2/1623;
(Continued)

(56) References Cited

U.S. PATENT DOCUMENTS 6,431,690 B1 8/2002 Shinkai et al.
8,091,987 B2 1/2012 Van Den Bergen
(Continued)

FOREIGN PATENT DOCUMENTS

EP 3150381 A 4/2017
JP 2012-025119 A 2/2012
(Continued)

OTHER PUBLICATIONS

IP.com search (Year: 2020).*
(Continued)

*Primary Examiner* — Lisa Solomon
(74) *Attorney, Agent, or Firm* — Brinks Gilson & Lione

(57) ABSTRACT

A liquid jet head chip capable of exerting a stable ejection performance is provided. The liquid jet head chip is provided with an actuator plate and an electrode. The actuator plate has an obverse surface, a reverse surface, and two or more ejection channels which penetrate the actuator plate in a thickness direction from the obverse surface toward the reverse surface, which are disposed so as to be adjacent to each other at intervals in a first direction perpendicular to the thickness direction, and which are disposed so as to extend in a second direction perpendicular to both of the thickness direction and the first direction. The electrode is disposed on an inner surface of the ejection channel, and includes a first electrode part covering the inner surface of the ejection channel continuously from the obverse surface toward the reverse surface, and a second electrode part covering the inner surface of the ejection channel continuously from the reverse surface toward the obverse surface, and overlapping at least a part of the first electrode part.

14 Claims, 26 Drawing Sheets

(58) Field of Classification Search
CPC ..... B41J 2202/11; B41J 2002/14362; B41J 2/1642; B41J 2/1632; B41J 2/1609; B41J 2/18; B41J 2002/14491; B41J 2202/12; B41J 2/01; B41J 2/14
See application file for complete search history.

(56) References Cited

U.S. PATENT DOCUMENTS

| | | | |
|---|---|---|---|
| 2002/0003558 | A1 | 1/2002 | Harajiri |
| 2013/0340219 | A1 | 12/2013 | Wang et al. |
| 2016/0075133 | A1 | 3/2016 | Morooka et al. |

FOREIGN PATENT DOCUMENTS

| | | | |
|---|---|---|---|
| JP | 2015-085534 | A | 5/2015 |
| JP | 2017-052214 | A | 3/2017 |

OTHER PUBLICATIONS

Machine Translation of JP20150855345A, "Manufacturing Method of Liquid Jet Head, and Liquid Jet Head and Liquid Jet Device", Paragraphs 0048, 0049, 0051-0052, May 7, 2015 (Year: 2015).*
Extended European Search Report for Europe Application No. 19208104.0, dated Mar. 25, 2020, 11 pages.

* cited by examiner

LIQUID JET HEAD CHIP, LIQUID JET HEAD, LIQUID JET RECORDING DEVICE, AND METHOD OF FORMING LIQUID JET HEAD CHIP

RELATED APPLICATIONS

This application claims priority to Japanese Patent Application Nos. 2018-211472 filed on Nov. 9, 2018, the entire content of which is incorporated herein by reference.

BACKGROUND OF THE INVENTION

1. Field of the Invention

The present disclosure relates to a liquid jet head chip, a method of forming the liquid jet head chip, a liquid jet head, and a liquid jet recording device.

2. Description of the Related Art

As one of liquid jet recording devices, there is provided an inkjet type recording device for ejecting (jetting) ink (liquid) on a recording target medium such as recording paper to perform recording of images, characters, and so on (see, e.g., the specification of U.S. Pat. No. 8,091,987).

In the liquid jet recording device of this type, it is arranged so that the ink is supplied from an ink tank to an inkjet head (a liquid jet head), and then the ink is ejected from nozzle holes of the inkjet head toward the recording target medium to thereby perform recording of the images, the characters, and so on. Further, such an inkjet head is provided with a head chip for ejecting the ink.

Such a head chip is required to have a stable ink ejection performance small in variation in ink ejection amount and variation in ink ejection speed. Therefore, it is desired to provide a liquid jet head chip, a liquid jet head, and a liquid jet recording device each capable of exerting the stable ejection performance, and a method of forming such a liquid jet head chip.

SUMMARY OF THE INVENTION

A liquid jet head chip according to an embodiment of the present disclosure is provided with constituents described as (1) and (2) below:

(1) an actuator plate having an obverse surface, a reverse surface, and two or more ejection channels which penetrate the actuator plate in a thickness direction from the obverse surface toward the reverse surface, which are disposed so as to be adjacent to each other at intervals in a first direction perpendicular to the thickness direction and which are disposed so as to extend in a second direction perpendicular to both of the thickness direction and the first direction; and (2) an electrode disposed on an inner surface of the ejection channel.

Here, the electrode includes a first electrode part covering the inner surface of the ejection channel continuously from the obverse surface toward the reverse surface, and a second electrode part covering the inner surface of the ejection channel continuously from the reverse surface toward the obverse surface, and overlapping at least a part of the first electrode part.

A liquid jet head according to an embodiment of the present disclosure is equipped with the liquid head chip according to an embodiment of the present disclosure.

A liquid jet recording device according to an embodiment of the present disclosure is equipped with the liquid jet head according to an embodiment of the present disclosure, and a base to which the liquid jet head is attached.

A method of forming a liquid jet head chip according to an embodiment of the present disclosure includes operations (A) through (D) described below:

(A) providing an actuator plate having an obverse surface, a reverse surface, and two or more ejection channels which are dug down to an intermediate position from the obverse surface to the reverse surface in the thickness direction perpendicular to the obverse surface and the reverse surface, which are disposed so as to be adjacent to each other at intervals in a first direction perpendicular to the thickness direction and which are disposed so as to extend in a second direction perpendicular to both of the thickness direction and the first direction;

(B) evaporating a first electrode part on an inner surface of the ejection channel from the obverse surface side;

(C) exposing the ejection channels on the reverse surface by grinding the actuator plate from the reverse surface side in the thickness direction; and (D) evaporating a second electrode part on the inner surface of the ejection channel exposed on the reverse surface from the reverse surface side so as to partially overlap the first electrode part, to thereby form an electrode including the first electrode part and the second electrode part.

According to the liquid jet head chip, the liquid jet head, and the liquid jet recording device related to an embodiment of the present disclosure, it is possible to exert a stable ejection performance. Specifically, for example, since the electrode is formed so as to continuously cover from the obverse surface to the reverse surface, the variation in the area of the electrode to be formed on the plurality of ejection channels is reduced, and it is possible to reduce the variation in ejection amount of the liquid and the variation in ejection speed of the liquid to be ejected from the plurality of ejection channels. Further, since the variation in the area of the electrodes to be formed respectively in the plurality of ejection channels is reduced, the variation in the capacitance in the liquid jet head chip, for example, is reduced, and thus, reduction of the variation in temperature in the liquid jet head chip when ejecting the liquid is expected. As a result, it is possible to further reduce the variation in ejection amount of the liquid and the variation in ejection speed of the liquid to be ejected from the ejection channels. Further, according to the method of forming the liquid jet head chip related to an embodiment of the present disclosure, it is possible to form the liquid jet head chip capable of exerting the stable ejection performance as described above.

DETAILED DESCRIPTION OF THE PREFERRED EMBODIMENTS

An embodiment of the present disclosure will hereinafter be described in detail with reference to the drawings. It should be noted that the description will be presented in the following order:

1. Embodiment (an example of an edge-shoot type inkjet head in which a flow channel plate is disposed between a pair of head chips, and which performs ink circulation)

2. Modified Examples

Modified Example 1 (an example of an edge-shoot type inkjet head in which a flow channel plate is disposed between a pair of head chips, and which does not perform ink circulation)

Modified Example 2 (an example of an edge-shoot type inkjet head in which a head chip is disposed on one side of a flow channel plate, and which performs ink circulation)

3. Other Modified Examples

1. EMBODIMENT

[Overall Configuration of Printer 1]

Figure 1:
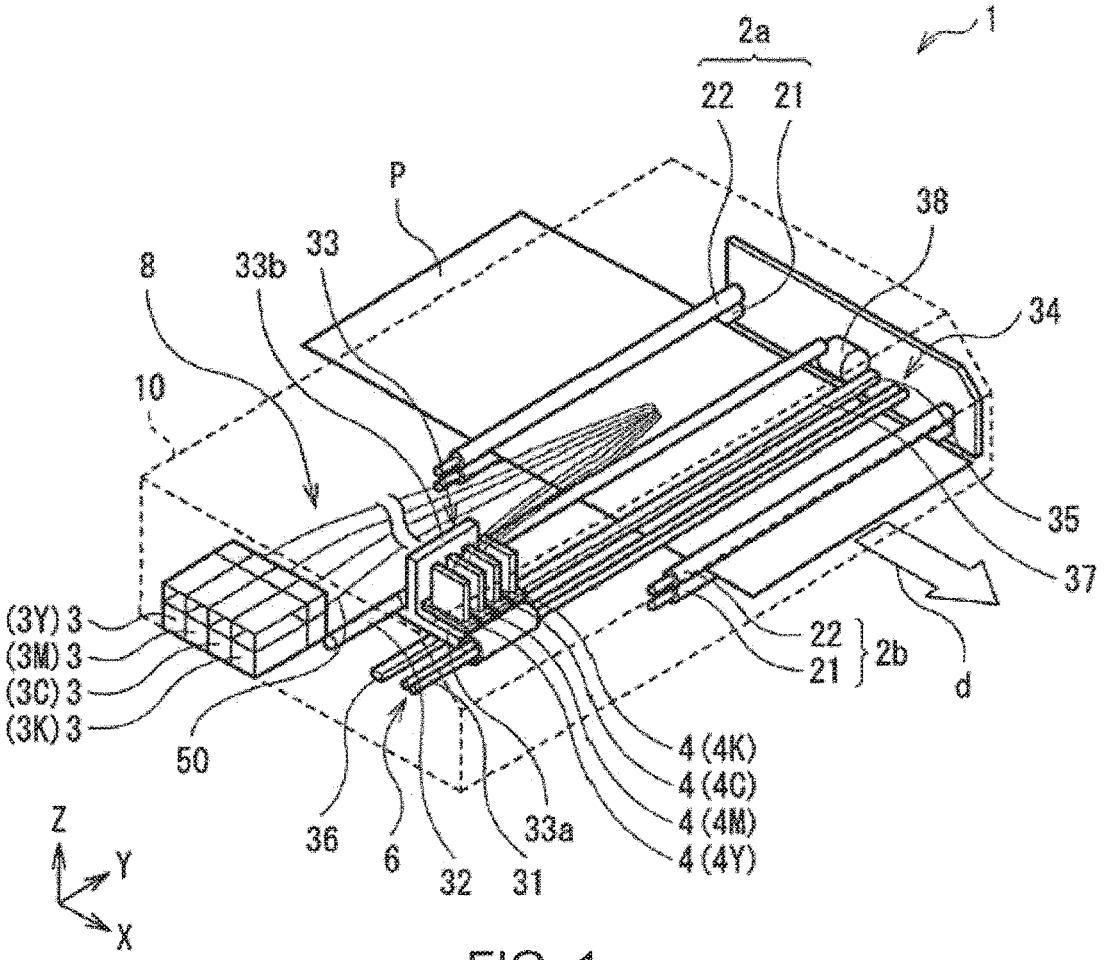
FIG. 1 is a schematic perspective view showing a schematic configuration example of a liquid jet recording device according to an embodiment of the present disclosure.

FIG. 1 is a perspective view schematically showing a schematic configuration example of a printer 1 as a liquid jet recording device according to an embodiment of the present disclosure. The printer 1 is an inkjet printer for performing recording (printing) of images, characters, and the like on recording paper P as a recording target medium using ink.

As shown in FIG. 1, the printer 1 is provided with a pair of carrying mechanisms 2*a*, 2*b*, ink tanks 3, inkjet heads 4, supply tubes 50, a scanning mechanism 6, and an ink circulation mechanism 8. These members are housed in a housing 10 having a predetermined shape. It should be noted that the scale size of each of the members is accordingly altered so that the member is shown large enough to recognize in the drawings used in the description of the specification.

Here, the printer 1 corresponds to a specific example of the "liquid jet recording device" in the present disclosure, and the inkjet heads 4 (the inkjet heads 4Y, 4M, 4C, and 4K described later) each correspond to a specific example of the "liquid jet head" in the present disclosure.

The carrying mechanisms 2*a*, 2*b* are each a mechanism for carrying the recording paper P along the carrying direction d (an X-axis direction) as shown in FIG. 1. These carrying mechanisms 2*a*, 2*b* each have a grit roller 21, a pinch roller 22 and a drive mechanism (not shown). The grit roller 21 and the pinch roller 22 are each disposed so as to extend along a Y-axis direction (the width direction of the recording paper P). The drive mechanism is a mechanism for rotating (rotating in a Z-X plane) the grit roller 21 around an axis, and is constituted by, for example, a motor.

(Ink Tanks 3)

The ink tanks 3 are each a tank for containing the ink inside. As the ink tanks 3, there are disposed four types of tanks for individually containing the ink of four colors of yellow (Y), magenta (M), cyan (C), and black (K) in this example as shown in FIG. 1. In other words, there are disposed the ink tank 3Y for containing the yellow ink, the ink tank 3M for containing the magenta ink, the ink tank 3C for containing the cyan ink, and the ink tank 3K for containing the black ink. These ink tanks 3Y, 3M, 3C, and 3K are arranged side by side along the X-axis direction inside the housing 10.

It should be noted that the ink tanks 3Y, 3M, 3C, and 3K have the same configuration except the color of the ink contained, and are therefore collectively referred to as ink tanks 3 in the following description.

(Inkjet Heads 4)

The inkjet heads 4 are each a head for jetting (ejecting) the ink having a droplet shape from a plurality of nozzles 78 described later to the recording paper P to thereby perform recording of images, characters, and so on. As the inkjet heads 4, there are also disposed four types of heads for individually jetting the four colors of ink respectively contained in the ink tanks 3Y, 3M, 3C, and 3K described above in this example as shown in FIG. 1. In other words, there are disposed the inkjet head 4Y for jetting the yellow ink, the inkjet head 4M for jetting the magenta ink, the inkjet head 4C for jetting the cyan ink, and the inkjet head 4K for jetting the black ink. These inkjet heads 4Y, 4M, 4C and 4K are arranged side by side along the Y-axis direction inside the housing 10.

It should be noted that the inkjet heads 4Y, 4M, 4C, and 4K have the same configuration except the color of the ink used, and are therefore collectively referred to as inkjet heads 4 in the following description. Further, the detailed configuration of the inkjet heads 4 will be described later (see FIG. 2 and so on).

The supply tubes 50 are each a tube for supplying the ink from the inside of the ink tank 3 to the inside of the inkjet head 4.

(Scanning Mechanism 6)

The scanning mechanism 6 is a mechanism for making the inkjet heads 4 perform a scanning operation along the width direction (the Y-axis direction) of the recording paper P. As shown in FIG. 1, the scanning mechanism 6 has a pair of guide rails 31, 32 disposed so as to extend along the Y-axis direction, a carriage 33 movably supported by these guide rails 31, 32, and a drive mechanism 34 for moving the carriage 33 along the Y-axis direction. Further, the drive mechanism 34 has a pair of pulleys 35, 36 disposed between the guide rails 31, 32, an endless belt 37 wound between the pair of pulleys 35, 36, and a drive motor 38 for rotationally driving the pulley 35.

The pulleys 35, 36 are respectively disposed in areas corresponding to the vicinities of both ends in each of the guide rails 31, 32 along the Y-axis direction. To the endless belt 37, there is coupled the carriage 33. The carriage 33 has a base 33*a* having a plate-like shape for mounting the four types of inkjet heads 4Y, 4M, 4C, and 4K described above, and a wall section 33*b* erected vertically (in the Z-axis direction) from the base 33*a*. On the base 33*a*, the inkjet heads 4Y, 4M, 4C, and 4K are arranged side by side along the Y-axis direction.

It should be noted that it is arranged that there is constituted a moving mechanism for moving the inkjet heads 4 and the recording paper P relatively to each other by such a scanning mechanism 6 and the carrying mechanisms 2*a*, 2*b* described above.

(Ink Circulation Mechanism 8)

Figure 2:
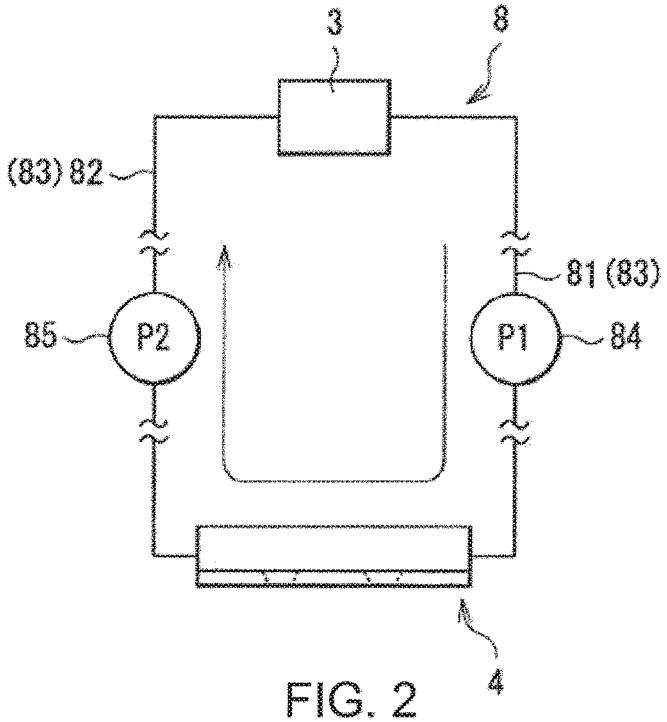
FIG. 2 is a schematic diagram showing a schematic configuration example of a liquid jet head and an ink circulation mechanism shown in FIG. 1.

FIG. 2 is a schematic diagram showing a schematic configuration example of the ink circulation mechanism 8. The ink circulation mechanism 8 is a mechanism for circulating the ink between the ink tank 3 and the inkjet head 4, and is provided with a circulation flow channel 83 constituted by an ink supply tube 81 and an ink discharge tube 82, a pressure pump 84 provided to the ink supply tube 81, and a suction pump 85 provided to the ink discharge tube 82. The ink supply tube 81 and the ink discharge tube 82 are each formed of, for example, a flexible hose having flexibility to the extent of being capable of following the action of the scanning mechanism 6 for supporting the inkjet heads 4.

The pressure pump 84 is for pressurizing the inside of the ink supply tube 81 to deliver the ink to the inkjet head 4 through the ink supply tube 81. Due to the function of the pressure pump 84, the inside of the ink supply tube 81 between the pressure pump 84 and the inkjet head 4 is provided with positive pressure with respect to the inkjet head 4.

The suction pump 85 is for depressurizing the inside of the ink discharge tube 82 to suction the ink from the inkjet head 4 through the ink discharge tube 82. Due to the function of the suction pump 85, the inside of the ink discharge tube 82 between the suction pump 85 and the inkjet head 4 is provided with negative pressure with respect to the inkjet head 4. It is arranged that the ink can circulate between the inkjet head 4 and the ink tank 3 through the circulation flow channel 83 by driving the pressure pump 84 and the suction pump 85. It should be noted that the ink circulation mechanism 8 is not limited to the configuration described above, but can also be provided with other configurations.

[Detailed Configuration of Inkjet Head 4]

Figure 3:
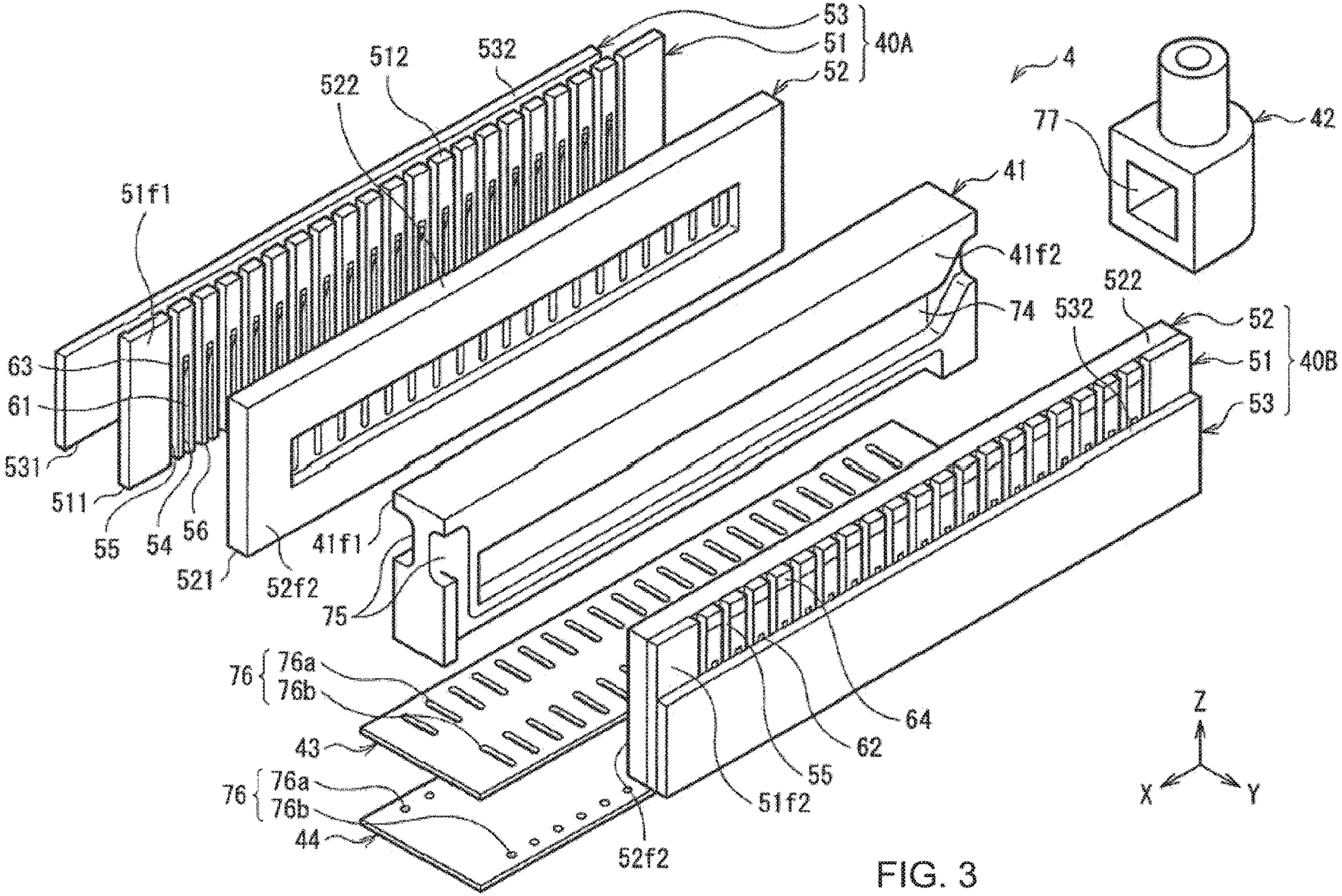
FIG. 3 is an exploded perspective view of the liquid jet head shown in FIG. 1.
Figure 4:
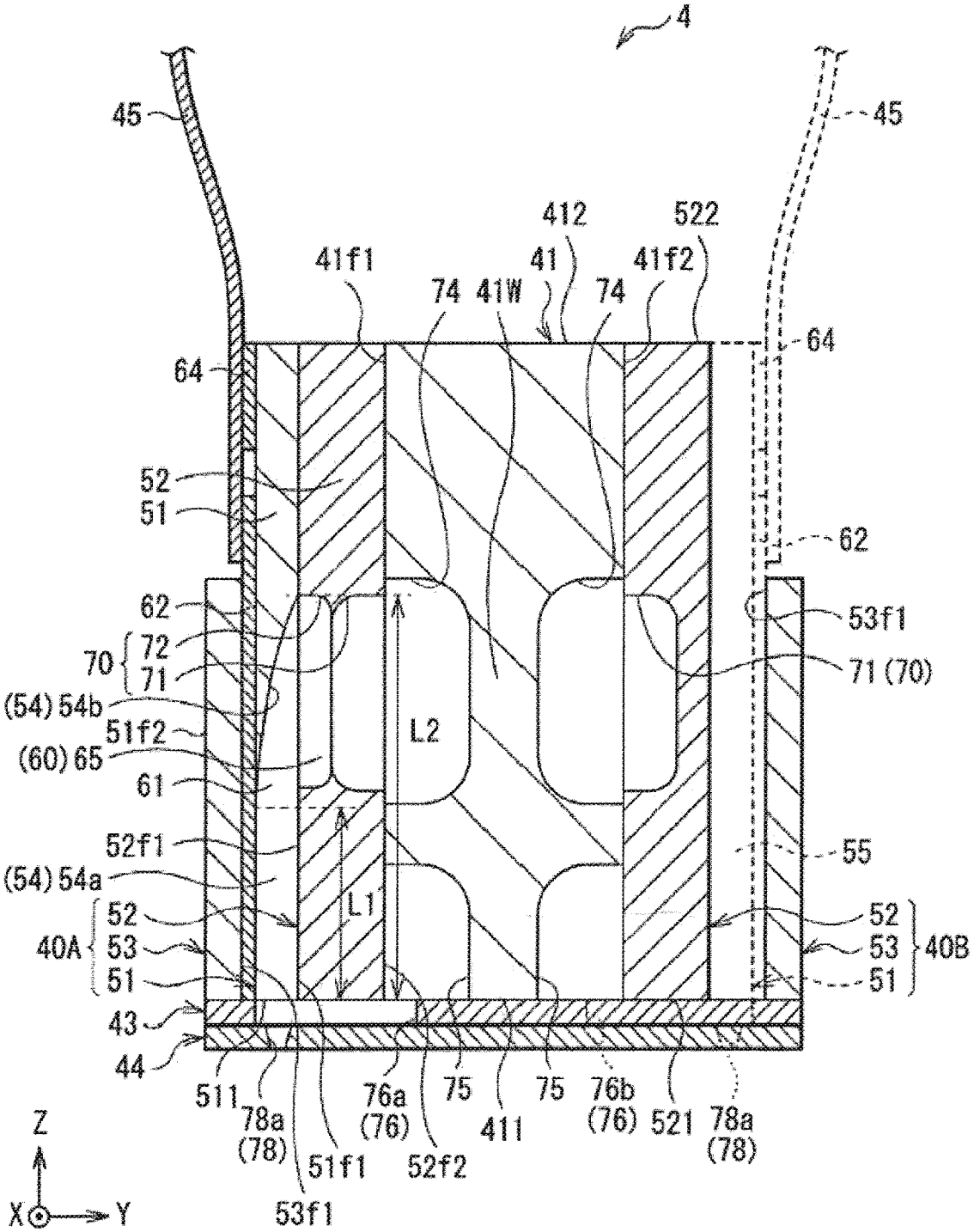
FIG. 4 is a cross-sectional view of the liquid jet head shown in FIG. 1.
Figure 5:
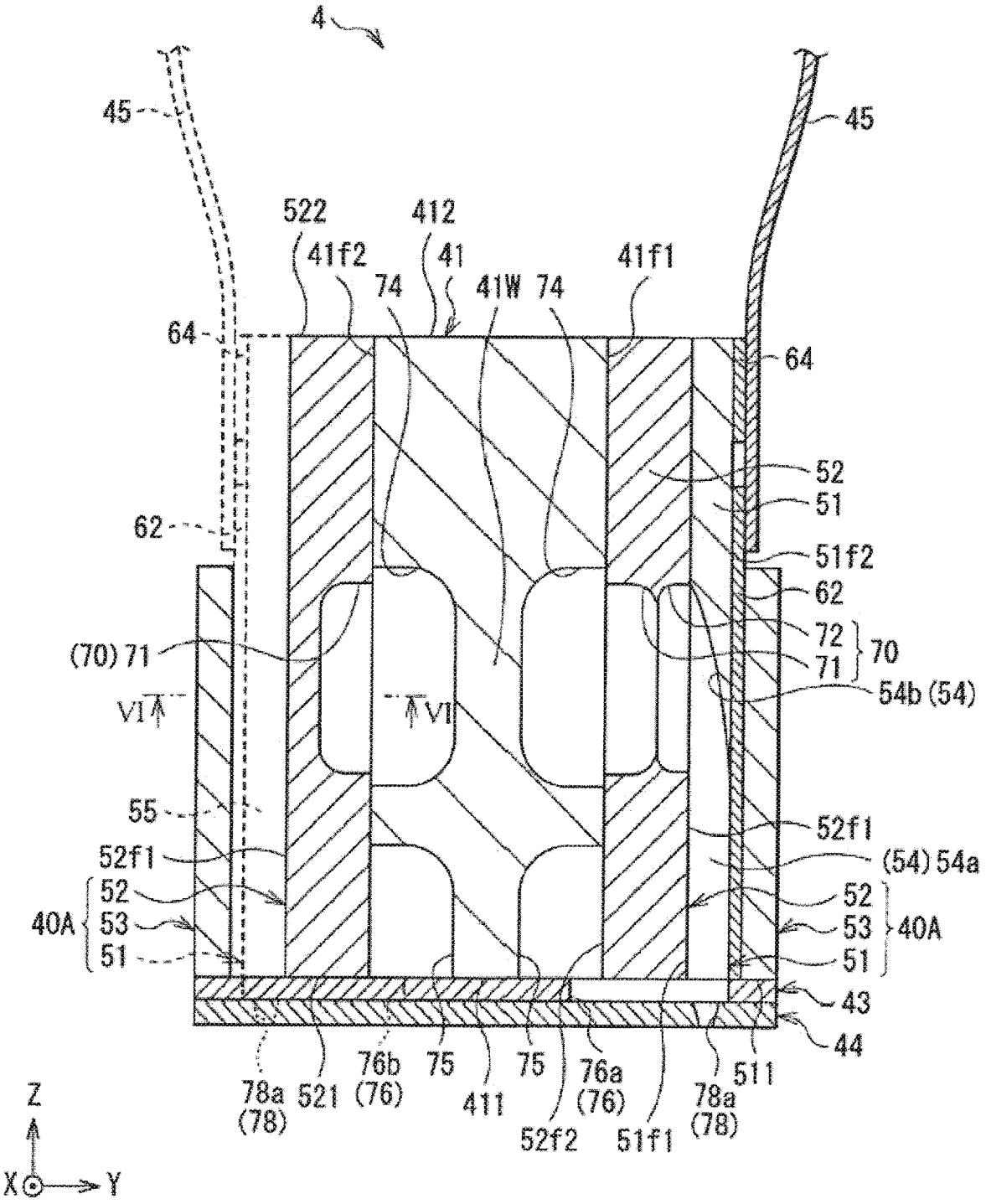
FIG. 5 is another cross-sectional view of the liquid jet head shown in FIG. 1.
Figure 6A:
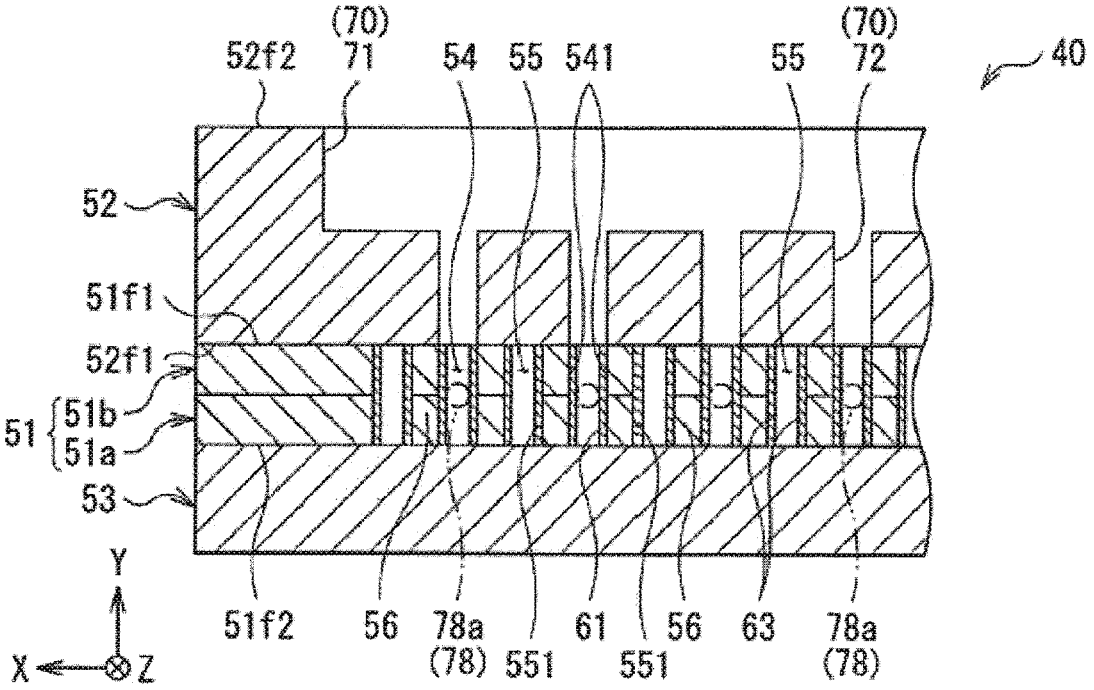
FIG. 6A is a cross-sectional view showing a cross-sectional surface perpendicular to an extending direction of an ejection channel in an actuator plate of the liquid jet head shown in FIG. 1.
Figure 6B:
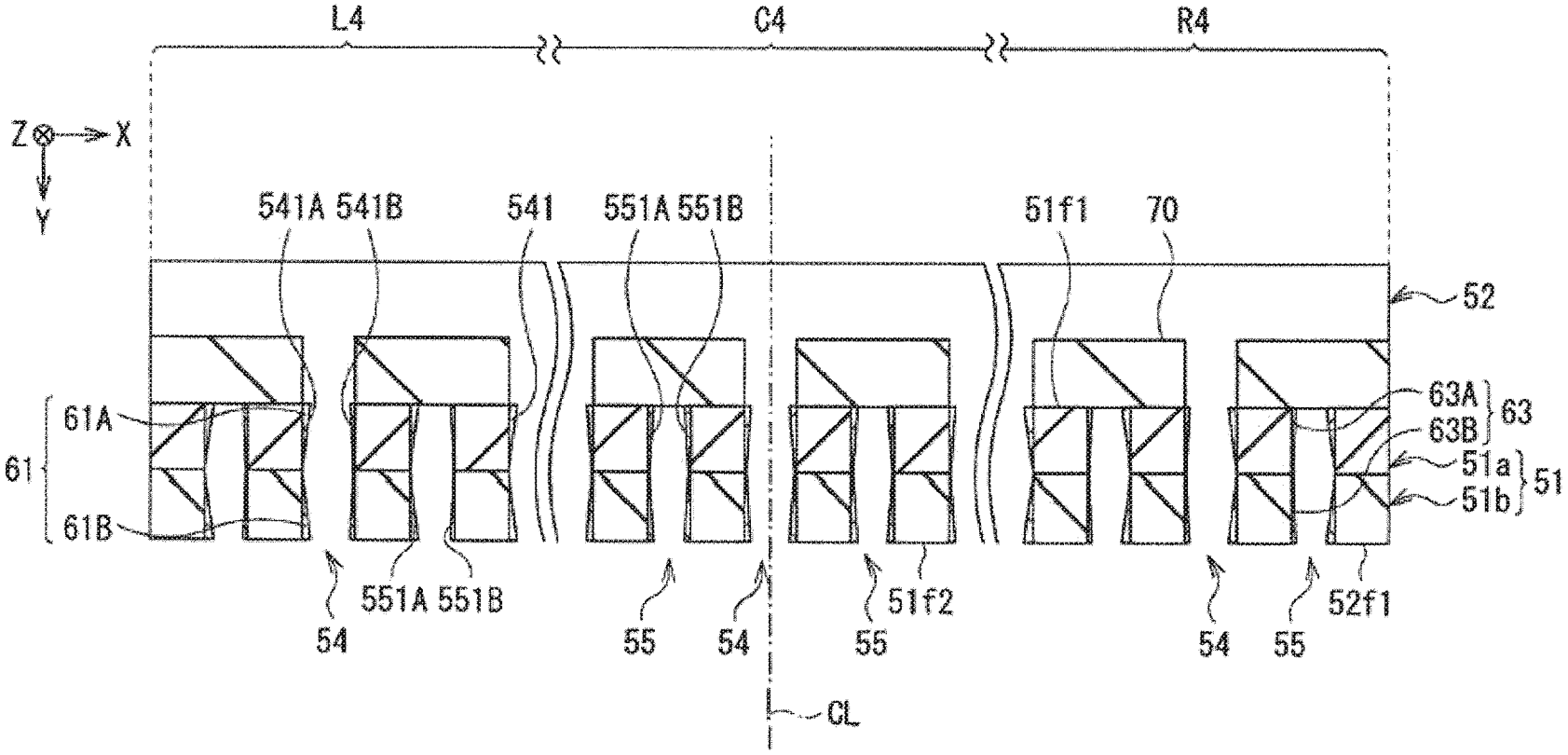
FIG. 6B is an enlarged cross-sectional view showing, in an enlarged manner, the actuator plate of the liquid jet head shown in FIG. 6A.
Figure 6C:
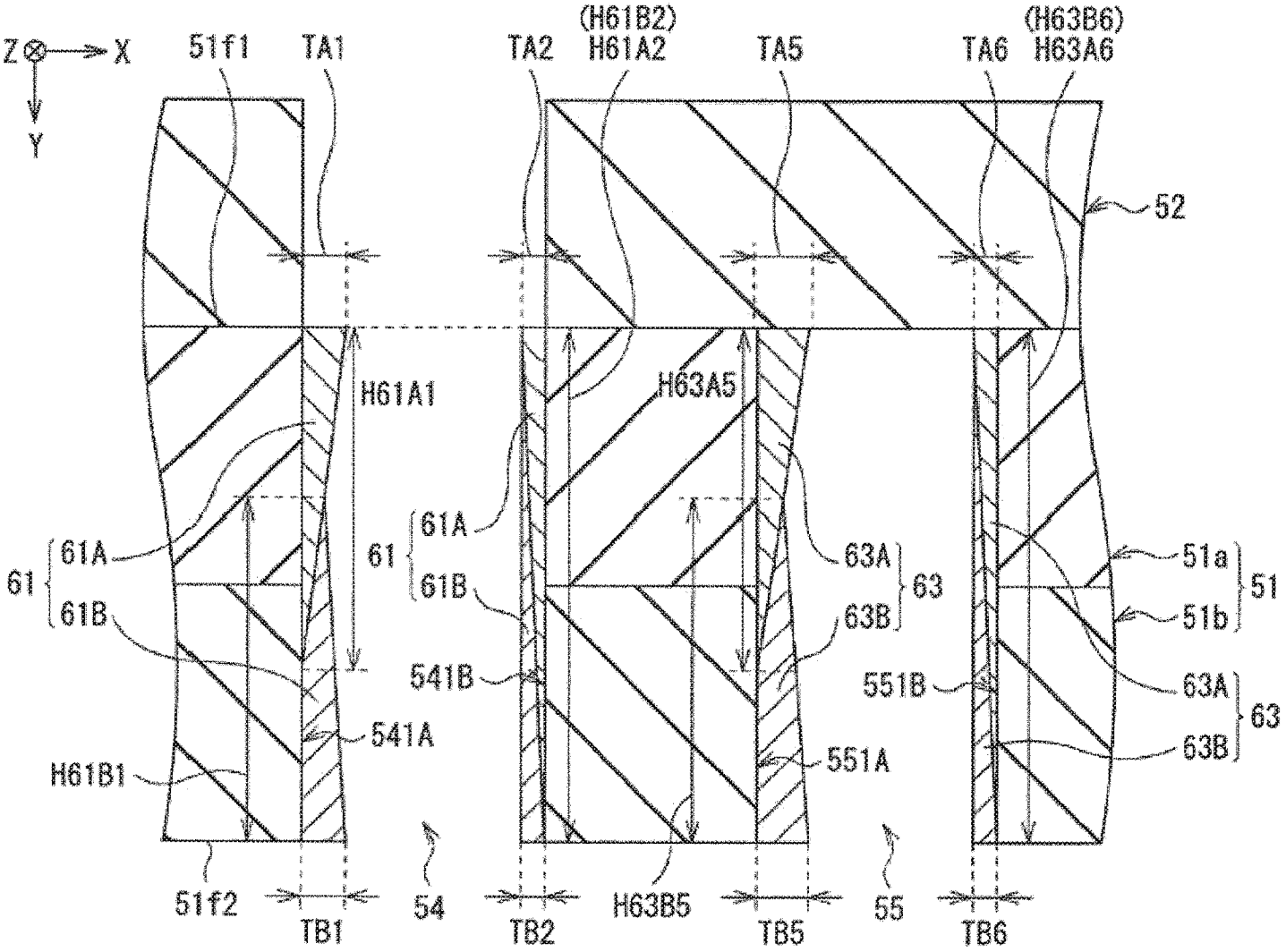
FIG. 6C is an enlarged cross-sectional view showing, in a further enlarged manner, an end part of the actuator plate of the liquid jet head shown in FIG. 6B.
Figure 6D:
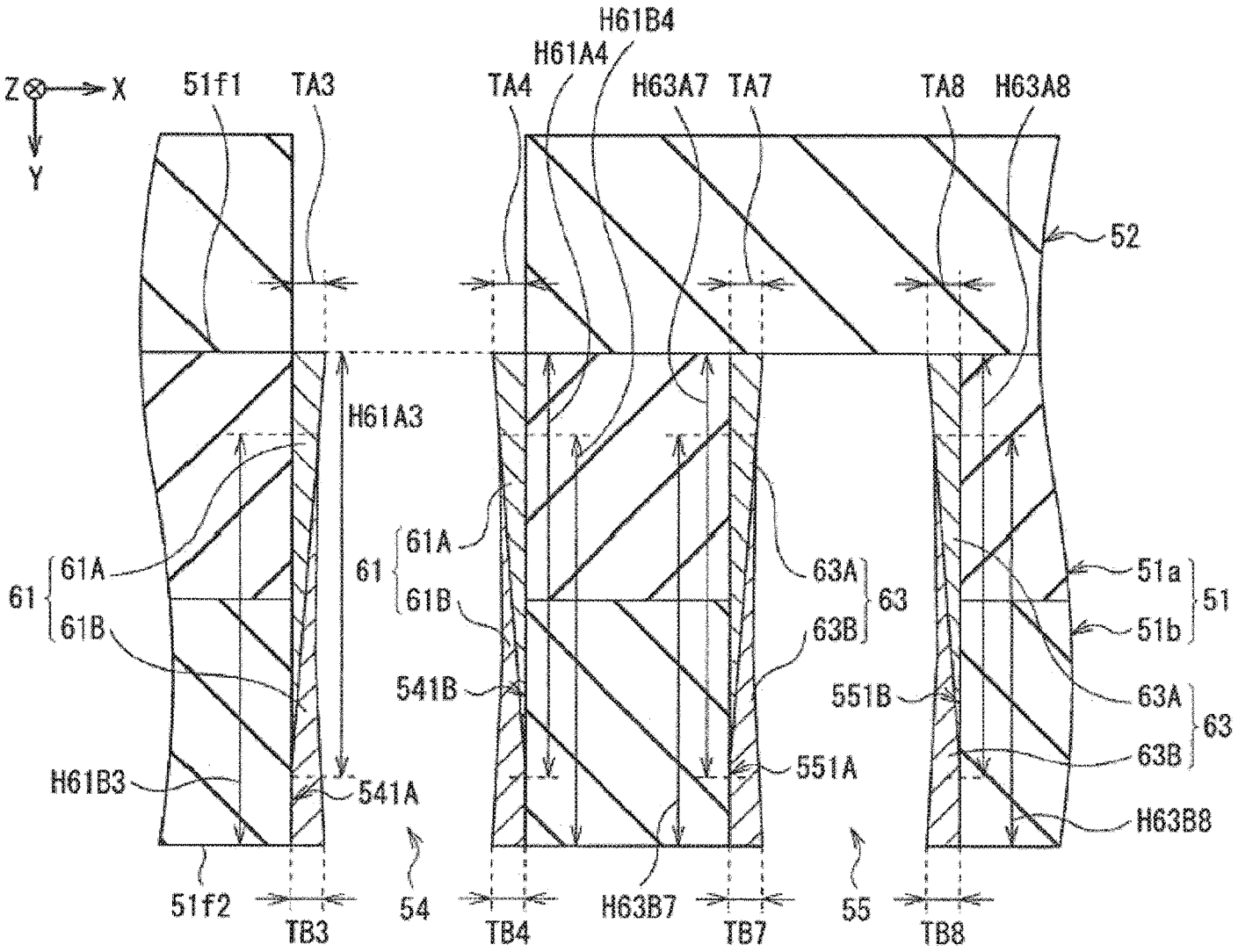
FIG. 6D is an enlarged cross-sectional view showing, in a further enlarged manner, a central part of the actuator plate of the liquid jet head shown in FIG. 6B.
Figure 6E:
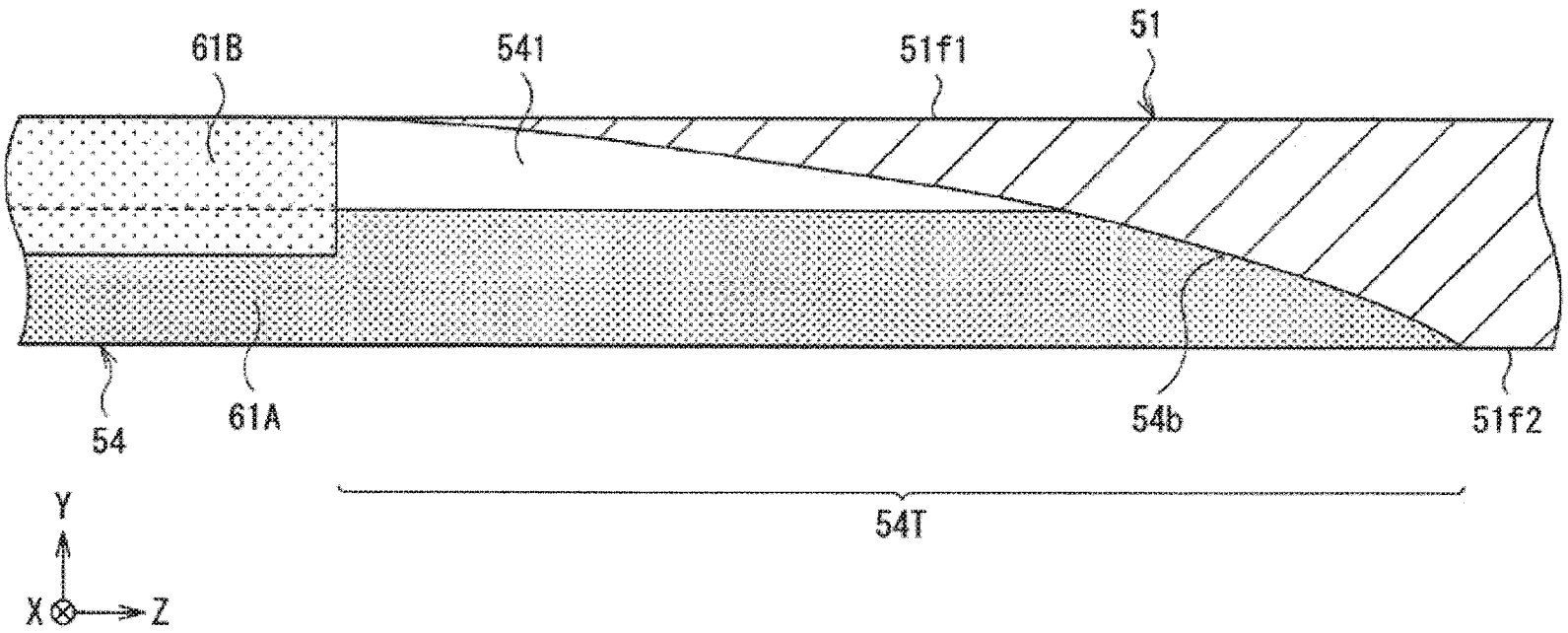
FIG. 6E is a schematic diagram showing, in an enlarged manner, a configuration of the ejection channel shown in FIG. 6A.
Figure 7:
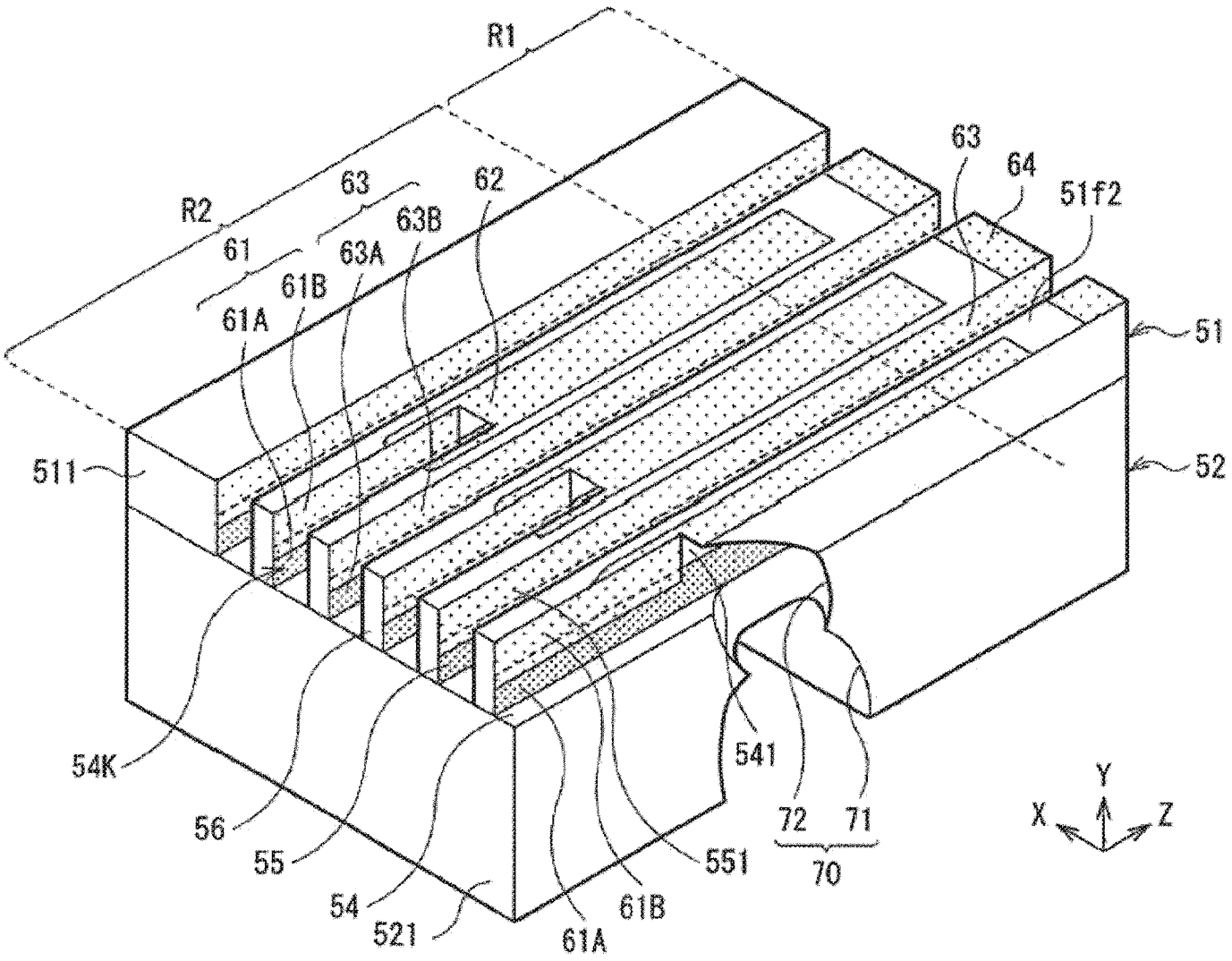
FIG. 7 is a partially broken perspective view showing, in an enlarged manner, a part of the liquid jet head chip shown in FIG. 3.

Then, the detailed configuration example of the inkjet head 4 will be described with reference to FIG. 3 through FIG. 8 in addition to FIG. 1. FIG. 3 is a perspective view showing the detailed configuration example of the inkjet head 4. FIG. 4 is a cross-sectional view showing a configuration example of the Y-Z cross-sectional surface including ejection channels 54 (described later) of a head chip 40A (described later) and dummy channels 55 (described later) of a head chip 40B (described later) in the inkjet head 4. FIG. 5 is a cross-sectional view showing a configuration example of the Y-Z cross-sectional surface including the dummy channels 55 (described later) of the head chip 40A and the ejection channels 54 (described later) of the head chip 40B in the inkjet head 4. FIG. 6A is a cross-sectional view showing a cross-sectional surface (the X-Y cross-sectional surface) perpendicular to the extending direction (the Z-axis direction) of the ejection channels 54 and the dummy channels 55 in the inkjet head 4. FIG. 6B is an enlarged cross-sectional view showing, in an enlarged manner, the cross-sectional surface (the X-Y cross-sectional surface) of the inkjet head 4 shown in FIG. 6A. It should be noted that in FIG. 6B, out of the parts of the inkjet head 4, both end parts (end parts R4, L4) in the X-axis direction and a central part C4 in the X-axis direction are shown, and a part between the end part R4 and the central part C4, and a part between the end part L4 and the central part C4 are omitted from the illustration. In FIG. 6B, a center line CL represented by the dashed-dotted line represents a central position in the X-axis direction in the inkjet head 4. It should be noted that in FIGS. 9A through 9J described later, the both end parts (the end parts R4, L4) in the X-axis direction, and the central part C4 in the X-axis direction of the inkjet head 4 are shown, and the parts between the both end parts (the end parts R4, L4) and the central part C4 are omitted from the illustration in a similar manner. FIG. 6C is a cross-sectional view showing, in an enlarged manner, a part of the end part L4 out of the parts of the inkjet head 4 shown in FIG. 6B, and FIG. 6D is a cross-sectional view showing, in an enlarged manner, a part of the central part C4 out of the parts of the inkjet head 4 shown in FIG. 6B. It should be noted that since the end part R4 out of the parts of the inkjet head 4 has a cross-sectional configuration substantially line-symmetric with the end part L4 about the center line CL (FIG. 6B) as the axis of symmetry, the description and the illustration of the end part R4 are omitted in the present specification. Further, FIG. 6E is a schematic diagram showing a configuration of the ejection channel 54 along the Y-Z plane in an enlarged manner. FIG. 7 is a partially broken perspective view showing a part of the head chip 40 in an enlarged manner.

As shown in FIG. 3, the inkjet head 4 is provided with the pair of head chips 40A, 40B, a flow channel plate 41, an entrance manifold 42, an exit manifold (not shown), a return plate 43, and a nozzle plate (jet plate) 44. The inkjet head 4 is of a circulation type (an edge-shoot circulation type) for circulating the ink between the inkjet head 4 and the ink tank 3 out of so-called edge-shoot types for ejecting the ink from a tip part in the extending direction (the Z-axis direction) of the ejection channel 54.

(Head Chips 40A, 40B)

The pair of head chips 40A, 40B have respective configurations substantially the same as each other, and are disposed at substantially symmetrical positions so as to have substantially symmetric postures across the flow channel plate 41 in the Y-axis direction. Hereinafter, the description will be presented collectively referring the pair of head chips 40A, 40B as head chips 40 unless the discrimination therebetween is particularly required. It should be noted that the head chip 40 corresponds to a specific example of a "liquid jet head chip" in the present disclosure. The head chip 40 is provided with a cover plate 52, an actuator plate 51, and a sealing plate 53 in this order from a position near to the flow channel plate 41.

(Actuator Plate 51)

The actuator plate 51 is a plate-like member expanding along the X-Z plane having the X-axis direction as the longitudinal direction, and the Z-axis direction as the short-side direction, and has a first surface 51*f*1 opposed to the cover plate 52, and a second surface 51*f*2 opposed to the sealing plate 53. It should be noted that the "first surface 51*f*1" is a specific example corresponding to an "obverse surface" of the present disclosure, and the "second surface 51*f*2" is a specific example corresponding to a "reverse surface" of the present disclosure. As shown in FIG. 7, the second surface 5112 includes an end part region R1 and a channel forming region R2. The end part region R1 is a part exposed outside without overlapping the sealing plate 53, and the channel forming region R2 is a part in which the ejection channels 54 and the dummy channels 55 are formed, and which overlaps the sealing plate 53. The actuator plate 51 is a stacked substrate of a so-called chevron type obtained by stacking two piezoelectric substrates 51*a*, 51*b* having respective polarization directions different from each other in the thickness direction (the Y-axis direction) and connecting the first surface 51*f*1 and the second surface 51*f*2 to each other (see FIGS. 6A trough 6E). As those piezoelectric substrates 51*a*, 51*b*, there are preferably used ceramics substrates formed of a piezoelectric material such as PZT (lead zirconate titanate).

The actuator plate 51 has the plurality of ejection channels 54 and the plurality of dummy channels 55 penetrating in the thickness direction (the Y-axis direction), and each linearly extending in the Z-axis direction. The ejection channels 54 and the dummy channels 55 are alternately disposed so as to be separated from each other in the X-axis direction. The discharge channels 54 and the dummy channels 55 are separated by drive walls 56, respectively. Therefore, the actuator plate 51 has a structure in which channels each having a slit-like shape are arranged in a cross-sectional surface (the X-Y cross-sectional surface) perpendicular to the Z-axis direction (see FIG. 6A). It should be noted that the "ejection channels 54" and the "dummy channels 55" are specific examples corresponding to "ejection channels" and "non-ejection channels" in the present disclosure, respectively.

The ejection channels 54 are each a part functioning as a pressure chamber for applying pressure to the ink, and each have a pair of inner surfaces 541 opposed to each other in the X-axis direction. The pair of inner surfaces 541 are each a plane parallel to the Y-Z plane, for example. A lower end part of each of the ejection channels 54 is disposed so as to extend to a lower end surface 511 (a surface opposed to the return plate 43) of the actuator plate 51 as shown in FIG. 7 to form an opening 54K opposed to the return plate 43. The opening 54K is an ejection end from which the ink is ejected. In contrast, an upper end part of each of the ejection channels 54 terminates within the actuator plate 51 without reaching an upper end surface (a surface on an opposite side to the return plate 43) 512 of the actuator plate 51. In other words, the vicinity of the upper end part of each of the ejection channels 54 forms a closed end located between the lower end surface 511 and the upper end surface 512, and including a tilted surface 54*b*, and is formed so that the depth (the dimension in the Y-axis direction) gradually decreases in a direction toward the upper end surface 512. In other words, the closed end 54T as an end part in the Z-axis direction in each of the ejection channels 54 includes the tilted surface 54*b* facing the cover plate 52 with a tilt. Therefore, a distance L1 from a crossing position between the tilted surface 54*b* and the second surface 51*f*2 to the lower end surface 511 as an ejection end is shorter than a second distance L2 from a crossing position between the tilted surface 54*b* and the first surface 51*f*1 to the lower end surface 511 (see FIG. 4). It should be noted that the lower end surface 511 and the upper end surface 512 are specific examples corresponding to a "front end surface" and a "back end surface" in the present disclosure, respectively.

The inner surfaces 541 of the ejection channel 54 each include a part covered with a common electrode 61 continuously, for example, from the first surface 51*f*1 to the second surface 51*f*2. As shown in FIG. 6B, the common electrode 61 has a first common electrode part 61A and a second common electrode part 61B. The first common electrode part 61A is disposed so as to cover the inner surface 541 of the ejection channel 54 continuously from the first surface 51*f*1 toward the second surface 51*f*2. The second common electrode part 61B is disposed so as to cover the inner surface 541 of the ejection channel 54 continuously from the second surface 51*f*2 toward the first surface 51*f*1, and at the same time so as to overlap at least a part of the first common electrode part 61A. Here, it is also possible for the first common electrode part 61A to cover the inner surface 541 continuously from the first surface 51*f*1 to the second surface 51*f*2, or to cover the inner surface 541 continuously from the first surface 51*f*1 halfway to the second surface 51*f*2. Similarly, it is also possible for the second common electrode part 61B to cover the inner surface 541 continuously from the second surface 51*f*2 to the first surface 51*f*, or to cover the inner surface 541 continuously from the second surface 51*f*2 halfway to the first surface 51*f*1. Further, in some cases, the first common electrode part 61A has a part in which the film thickness of the first common electrode part 61A decreases in a direction of approaching from the first surface 51*f*1 to the second surface 51*f*2 as shown in FIG. 6B. Similarly, in some cases, the second common electrode part 61B has a part in which the film thickness of the second common electrode part 61B decreases in a direction of approaching from the second surface 51*f*2 to the first surface 51*f*1. In that case, it is preferable for the common electrode 61 to be formed so that a part relatively small in film thickness of the first common electrode part 61A and a part relatively small in film thickness of the second common electrode part 61B overlap each other.

With reference to FIG. 6C and FIG. 6D, the common electrode 61 will be described in more detail. Firstly, with reference to FIG. 6C, a cross-sectional configuration of the end part L4 of the inkjet head 4 will be described in detail. As shown in FIG. 6C, in the end part L4, the thickness TA1 of the first common electrode part 61A to be formed on an inward side surface 541A facing to the center line CL out of the inner surfaces 541 of the ejection channel 54 is thicker than the thickness TA2 of the first common electrode part 61A to be formed on an outward side surface 541B facing to an opposite side to the center line CL out of the inner surfaces 541 of the ejection channel 54. The thickness TA1 mentioned here is a dimension in the X-axis direction of the thickest part of the first common electrode part 61A to be formed on the inward side surface 541A in the end part L4. In other words, in the end part L4, the thickness TA1 is a dimension in the X-axis direction at the nearest position to the first surface 51*f*1 in the Y-axis direction out of the first common electrode part 61A to be formed on the inward side surface 541A. Further, the thickness TA2 is a dimension in the X-axis direction of the thickest part of the first common electrode part 61A to be formed on the outward side surface 541B in the end part L4. In other words, in the end part L4, the thickness TA2 is a dimension in the X-axis direction at the nearest position to the first surface 51*f*1 in the Y-axis direction out of the first common electrode part 61A to be formed on the outward side surface 541B. Further, in the end part L4, the depth (the dimension in the Y-axis direction) H61A1 of the first common electrode part 61A to be formed on the inward side surface 541A is smaller than the depth (the dimension in the Y-axis direction) H61A2 of the first common electrode part 61A to be formed on the outward side surface 541B. It should be noted that in the example shown in FIG. 6C, the depth H61A2 of the first common electrode part 61A is substantially the same as the thickness of the actuator plate 51.

In the end part L4 of the inkjet head 4, the thickness TB1 of the second common electrode part 61B to be formed on the inward side surface 541A out of the inner surfaces 541 of the ejection channel 54 is thicker than the thickness TB2 of the second common electrode part 61B to be formed on the outward side surface 541B. The thickness TB1 mentioned here is a dimension in the X-axis direction of the thickest part of the second common electrode part 61B to be formed on the inward side surface 541A in the end part L4. In other words, in the end part L4, the thickness TB1 is a dimension in the X-axis direction at the nearest position to the second surface 51*f*2 in the Y-axis direction out of the second common electrode part 61B to be formed on the inward side surface 541A. Further, in the end part L4, the thickness TB2 is a dimension in the X-axis direction of the thickest part of the second common electrode part 61B to be formed on the outward side surface 541B. In other words, in the end part L4, the thickness TB2 is a dimension in the X-axis direction at the nearest position to the second surface 51*f*2 in the Y-axis direction out of the second common electrode part 61B to be formed on the outward side surface 541B. Further, in the end part L4, the depth H61B1 of the second common electrode part 61B to be formed on the inward side surface 541A is smaller than the depth H61B2 of the second common electrode part 61B to be formed on the outward side surface 541B. It should be noted that in the example shown in FIG. 6C, the depth H61B2 of the second common electrode part 61B is substantially the same as the thickness of the actuator plate 51.

Then, as shown in FIG. 6D, in the central part C4 in the X-axis direction out of the inkjet head 4, the thickness TA3 of the first common electrode part 61A to be formed on the inward side surface 541A and the thickness TA4 of the first common electrode part 61A to be formed on the outward side surface 541B are roughly equivalent to each other. The thickness TA3 and the thickness TA4 are both thinner than the thickness TA1 and thicker than the thickness TA2. The thickness TA3 mentioned here is a dimension in the X-axis direction of the thickest part of the first common electrode part 61A to be formed on the inward side surface 541A in the central part C4. In other words, in the central part C4, the thickness TA3 is a dimension in the X-axis direction at the nearest position to the first surface 51*f*1 in the Y-axis direction out of the first common electrode part 61A to be formed on the inward side surface 541A. Further, the thickness TA4 is a dimension in the X-axis direction of the thickest part of the first common electrode part 61A to be formed on the outward side surface 541B in the central part C4. In other words, in the central part C4, the thickness TA4 is a dimension in the X-axis direction at the nearest position to the first surface 51*f*1 in the Y-axis direction out of the first common electrode part 61A to be formed on the outward side surface 541B. Further, in the central part C4, the depth H61A3 of the first common electrode part 61A to be formed on the inward side surface 541A is roughly equivalent to the depth H61A4 of the first common electrode part 61A to be formed on the outward side surface 541B. It should be noted that the depth H61A3 and the depth H61A4 are both deeper than the depth H61A1, and smaller than the depth H61A2. It should be noted that the depth (the dimension in the Y-axis direction) of the first common electrode part 61A to be formed on the inward side surface 541A continuously changes so as to gradually increase in a direction from the end part L4 (or the end part R4) toward the central part C4. The depth (the dimension in the Y-axis direction) of the first common electrode part 61A to be formed on the outward side surface 541B continuously changes so as to gradually decrease in the direction from the end part L4 (or the end part R4) toward the central part C4.

In the central part C4 of the inkjet head 4, the thickness TB3 of the second common electrode part 61B to be formed on the inward side surface 541A out of the inner surfaces 541 of the ejection channel 54 and the thickness TB4 of the second common electrode part 61B to be formed on the outward side surface 541B are roughly equivalent to each other. The thickness TB3 and the thickness TB4 are both thinner than the thickness TA1 and thicker than the thickness TA2. The thickness TB3 mentioned here is a dimension in the X-axis direction of the thickest part of the second common electrode part 61B to be formed on the inward side surface 541A in the central part C4. In other words, in the central part C4, the thickness TB3 is a dimension in the X-axis direction at the nearest position to the second surface 51*f*2 in the Y-axis direction out of the second common electrode part 61B to be formed on the inward side surface 541A. Further, the thickness TB4 is a dimension in the X-axis direction of the thickest part of the second common electrode part 61B formed on the outward side surface 541B in the central part C4. In other words, in the central part C4, the thickness TB4 is a dimension in the X-axis direction at the nearest position to the second surface 51*f*2 in the Y-axis direction out of the second common electrode part 61B to be formed on the outward side surface 541B. Further, in the central part C4, the depth (the dimension in the Y-axis direction) H61B3 of the second common electrode part 61B to be formed on the inward side surface 541A is roughly equivalent to the depth (the dimension in the Y-axis direction) H61B4 of the second common electrode part 61B to be formed on the outward side surface 541B. It should be noted that the depth (the dimension in the Y-axis direction) of the second common electrode part 61B to be formed on the inward side surface 541A continuously changes so as to gradually increase in the direction from the end part L4 (or the end part R4) toward the central part C4. The depth (the dimension in the Y-axis direction) of the second common electrode part 61B formed on the outward side surface 541B continuously changes so as to gradually decrease in the direction from the end part L4 (or the end part R4) toward the central part C4.

Further, as shown in FIG. 6E, the closed end 54T as an end part in the Z-axis direction in the ejection channel 54 includes an exposed part in which the second common electrode part 61B is not formed, but the inner surface 541 of the ejection channel 54 or the first common electrode part 61A is exposed. This is a configuration caused by the manufacturing process of the common electrode 61. Since the closed end 54T includes the tilted surface 54*b* facing the cover plate 52 with a tilt, when forming the second common electrode part 61B by an evaporation method from the second surface 51*f*2 on the opposite side to the cover plate 52, it results in that the second common electrode part 61B is not formed on the inner surface 541 or the first common electrode part 61A in the closed end 54T.

The common electrode 61 is connected to a common electrode pad 62. The common electrode pad 62 is formed so as to cover a part of the peripheral part of the upper end part of the ejection channel 54 in the second surface 51*f*2. The common electrode pad 62 is disposed so as to extend from the peripheral part to the end part region R1 of the ejection channel 54 in the second surface 51*f*2. It should be noted that the common electrode 61 is a specific example corresponding to a "common electrode" or an "electrode" of the present disclosure, and the common electrode pad 62 is a specific example corresponding to a "common electrode pad" of the present disclosure.

Further, it is desirable that the depths H61B1, H61B3 of the second common electrode part 61B to be formed on the inward side surface 541A are smaller than the depths H61A1, H61A3 of the first common electrode part 61A to be formed on the inward side surface 541A. It should be noted that it is possible for the depths H61B1, H61B3 to be equivalent to the depths H61A1, H61A3, or it is also possible for the depths H61B1, H61B3 to be made deeper than the depths H61A1, H61A3. Similarly, it is desirable that the depths H61B2, H61B4 of the second common electrode part 61B to be formed on the outward side surface 541B are smaller than the depths H61A2, H61A4 of the first common electrode part 61A. It should be noted that it is possible for the depths H61B2, H61B4 to be equivalent to the depths H61A2, H61A4, or it is also possible for the depths H61B2, H61B4 to be made deeper than the depths H61A2, H61A4.

As shown in FIG. 6A and FIG. 6B, the dummy channels 55 each have a pair of inner surfaces 551 opposed to each other in the X-axis direction. The pair of inner surfaces 551 are each a plane parallel to the Y-Z plane, for example. The pair of inner surfaces 551 are each covered, for example, entirely with an individual electrode 63. As shown in FIG. 6B, the individual electrode 63 has a first individual electrode part 63A and a second individual electrode part 63B. The first individual electrode part 63A is disposed so as to cover the inner surface 551 of the dummy channel 55 continuously from the first surface 51*f*1 toward the second surface 51*f*2. The second individual electrode part 63B is disposed so as to cover the inner surface 551 of the dummy channel 55 continuously from the second surface 51*f*2 toward the first surface 51*f*1, and at the same time so as to overlap at least a part of the first individual electrode part 63A. Here, it is also possible for the first individual electrode part 63A to cover the inner surface 551 continuously from the first surface 51*f*1 to the second surface 51*f*2, or to cover the inner surface 551 continuously from the first surface 51*f*1 halfway to the second surface 51*f*2. Similarly, it is also possible for the second individual electrode part 63B to cover the inner surface 551 continuously from the second surface 51*f*2 to the first surface 51*f*1, or to cover the inner surface 551 continuously from the second surface 51*f*2 halfway to the first surface 51*f*1. Further, in some cases, the first individual electrode part 63A has a part in which the film thickness of the first individual electrode part 63A decreases in a direction of approaching from the first surface 51*f*1 to the second surface 51*f*2 as shown in FIG. 6B. Similarly, in some cases, the second individual electrode part 63B has a part in which the film thickness of the second individual electrode part 63B decreases in a direction of approaching from the second surface 51*f*2 to the first surface 51*f*1. In that case, it is preferable for the individual electrode 63 to be formed so that a part relatively small in film thickness of the first individual electrode part 63A and a part relatively small in film thickness of the second individual electrode part 63B overlap each other.

With reference to FIG. 6C and FIG. 6D, the individual electrode 63 will be described in more detail. Firstly, as shown in FIG. 6C, in the end part L4 of the inkjet head 4, the thickness TA5 of the first individual electrode part 63A to be formed on an inward side surface 551A facing to the center line CL out of the inner surfaces 551 of the dummy channel 55 is thicker than the thickness TA6 of the first individual electrode part 63A to be formed on an outward side surface 551B facing to the opposite side to the center line CL out of the inner surfaces 551 of the dummy channel 55. The thickness TA5 mentioned here is a dimension in the X-axis direction of the thickest part of the first individual electrode part 63A to be formed on the inward side surface 551A in the end part L4. In other words, in the end part L4, the thickness TA5 is a dimension in the X-axis direction at the nearest position to the first surface 51*f*1 in the Y-axis direction out of the first individual electrode part 63A to be formed on the inward side surface 551A. Further, the thickness TA6 is a dimension in the X-axis direction of the thickest part of the first individual electrode part 63A to be formed on the outward side surface 551B in the end part L4. In other words, in the end part L4, the thickness TA6 is a dimension in the X-axis direction at the nearest position to the first surface 51*f*1 in the Y-axis direction out of the first individual electrode part 63A formed on the outward side surface 551B. Further, in the end part L4, the depth (the dimension in the Y-axis direction) H63A5 of the first individual electrode part 63A to be formed on the inward side surface 551A is smaller than the depth (the dimension in the Y-axis direction) H63A6 of the first individual electrode part 63A to be formed on the outward side surface 551B. It should be noted that in the example of FIG. 6C, the depth H63A6 of the first individual electrode part 63A is substantially the same as the thickness of the actuator plate 51.

In the end part L4, the thickness TB5 of the second individual electrode part 63B to be formed on the inward side surface 551A out of the inner surfaces 551 of the dummy channel 55 is thicker than the thickness TB6 of the second individual electrode part 63B to be formed on the outward side surface 551B. The thickness TB5 mentioned here is a dimension in the X-axis direction of the thickest part of the second individual electrode part 63B formed on the inward side surface 551A in the end part L4. In other words, in the end part L4, the thickness TB5 is a dimension in the X-axis direction at the nearest position to the second surface 51*f*2 in the Y-axis direction out of the second individual electrode part 63B to be formed on the inward side surface 551A. Further, in the end part L4, the thickness TB6 is a dimension in the X-axis direction of the thickest part of the second individual electrode part 63B to be formed on the outward side surface 551B. In other words, in the end part L4, the thickness TB6 is a dimension in the X-axis direction at the nearest position to the second surface 51/2 in the Y-axis direction out of the second individual electrode part 63B to be formed on the outward side surface 551B. Further, in the end part L4, the depth (the dimension in the Y-axis direction) H63B5 of the second individual electrode part 63B to be formed on the inward side surface 551A is smaller than the depth (the dimension in the Y-axis direction) H63B6 of the second individual electrode part 63B to be formed on the outward side surface 551B. It should be noted that in the example shown in FIG. 6C, the depth H63B6 of the second individual electrode part 63B is substantially the same as the thickness of the actuator plate 51.

Then, as shown in FIG. 6D, in the central part C4 of the inkjet head 4, the thickness TA7 of the first individual electrode part 63A to be formed on the inward side surface 551A and the thickness TA8 of the first individual electrode part 63A to be formed on the outward side surface 551B are roughly equivalent to each other. The thickness TA7 and the thickness TA8 are both thinner than the thickness TA5 and thicker than the thickness TA6. The thickness TA7 mentioned here is a dimension in the X-axis direction of the thickest part of the first individual electrode part 63A to be formed on the inward side surface 551A in the central part C4. In other words, in the central part C4, the thickness TA7 is a dimension in the X-axis direction at the nearest position to the first surface 51/1 in the Y-axis direction out of the first individual electrode part 63A to be formed on the inward side surface 551A. Further, the thickness TA8 is a dimension in the X-axis direction of the thickest part of the first individual electrode part 63A to be formed on the outward side surface 551B in the central part C4. In other words, in the central part C4, the thickness TA8 is a dimension in the X-axis direction at the nearest position to the first surface 51/1 in the Y-axis direction out of the first individual electrode part 63A to be formed on the outward side surface 551B. Further, in the central part C4, the depth (the dimension in the Y-axis direction) H63A7 of the first individual electrode part 63A to be formed on the inward side surface 551A is roughly equivalent to the depth (the dimension in the Y-axis direction) H63A8 of the first individual electrode part 63A to be formed on the outward side surface 551B. It should be noted that the depth H63A7 and the depth H63A8 are both deeper than the depth H63A5, and smaller than the depth H63A6. It should be noted that the depth (the dimension in the Y-axis direction) of the first individual electrode part 63A to be formed on the inward side surface 551A continuously changes so as to gradually increase in the direction from the end part L4 (or the end part R4) toward the central part C4. The depth (the dimension in the Y-axis direction) of the first individual electrode part 63A to be formed on the outward side surface 551B continuously changes so as to gradually decrease in the direction from the end part L4 (or the end part R4) toward the central part C4.

In the central part C4 of the inkjet head 4, the thickness TB7 of the second individual electrode part 63B to be formed on the inward side surface 551A out of the inner surfaces 551 of the dummy channel 55 and the thickness TB8 of the second individual electrode part 63B to be formed on the outward side surface 551B are roughly equivalent to each other. The thickness TB7 and the thickness TB8 are both thinner than the thickness TB5 and thicker than the thickness TB6. The thickness TB7 mentioned here is a dimension in the X-axis direction of the thickest part of the second individual electrode part 63B to be formed on the inward side surface 551A in the central part C4. In other words, in the central part C4, the thickness TB7 is a dimension in the X-axis direction at the nearest position to the second surface 51/2 in the Y-axis direction out of the second individual electrode part 63B to be formed on the inward side surface 551A. Further, the thickness TB8 is a dimension in the X-axis direction of the thickest part of the second individual electrode part 63B to be formed on the outward side surface 551B in the central part C4. In other words, in the central part C4, the thickness TB8 is a dimension in the X-axis direction at the nearest position to the second surface 51/2 in the Y-axis direction out of the second individual electrode part 63B to be formed on the outward side surface 551B. Further, in the central part C4, the depth (the dimension in the Y-axis direction) H63B7 of the second individual electrode part 63B to be formed on the inward side surface 551A is roughly equivalent to the depth (the dimension in the Y-axis direction) H63B8 of the second individual electrode part 63B to be formed on the outward side surface 551B. It should be noted that the depth (the dimension in the Y-axis direction) of the second individual electrode part 63B to be formed on the inward side surface 551A continuously changes so as to gradually increase in the direction from the end part LA (or the end part R4) toward the central part C4. The depth (the dimension in the Y-axis direction) of the second individual electrode part 63B to be formed on the outward side surface 551B continuously changes so as to gradually decrease in the direction from the end part L4 (or the end part R4) toward the central part C4.

Further, the pair of individual electrodes 63 for respectively covering the pair of inner surfaces 551 in the dummy channel 55 are isolated from each other. The individual electrodes 63 are coupled to individual electrode pads 64 each covering a part of the end part region R1 of the second surface 51/2. It should be noted that in the present embodiment, the individual electrode pads 64 are each disposed so as to extend in a part located above the common electrode pad 62 out of the peripheral part. The individual electrode pads 64 each couple a pair of individual electrodes 63 adjacent to each other across the ejection channel 54. Here, the individual electrodes 63 and the individual electrode pad 64 are electrically isolated from the common electrodes 61 and the common electrode pad 62. It should be noted that the individual electrode 63 is a specific example corresponding to an "individual electrode" of the present disclosure, and the individual electrode pad 64 is a specific example corresponding to an "individual electrode pad" of the present disclosure. The common electrode pads 62 and the individual electrode pads 64 are coupled to an external wiring board (a flexible printed board) 45 (see FIG. 4 and FIG. 5). It should be noted that the common electrode pads 62 and the individual electrode pads 64 are electrically separated from each other.

(Cover Plate 52)

The cover plate 52 is a plate-like member having the X-axis direction as the longitudinal direction and the Z-axis direction as the short-side direction, and extending along the X-Z plane. The cover plate 52 has an opposed surface 52/1 opposed to the first surface 51/1 of the actuator plate 51.

Figure 8:
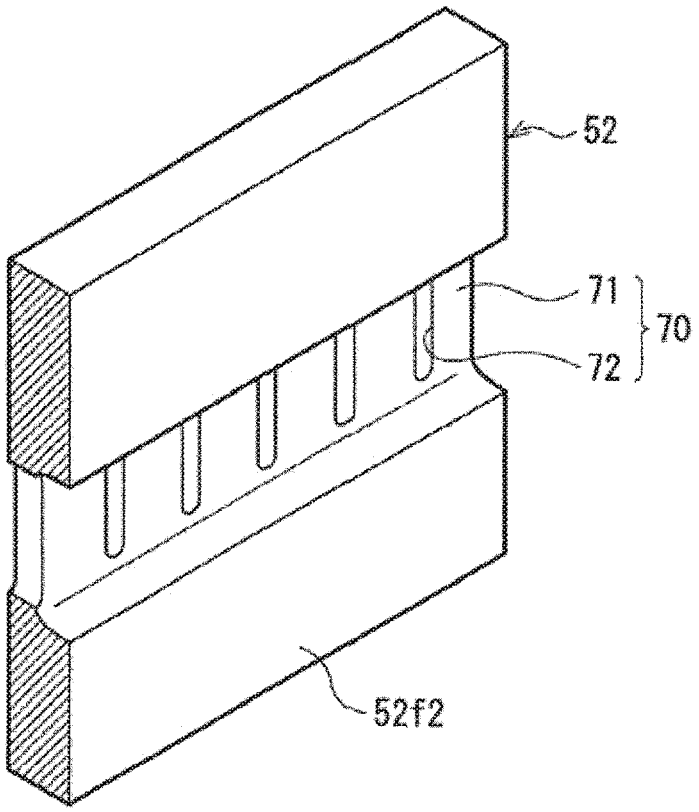
FIG. 8 is a perspective view showing, in an enlarged manner, a cover plate shown in FIG. 3.

FIG. 8 is a perspective view of the cover plate 52 viewed from the flow channel plate 41 side. The cover plate 52 is provided with a liquid supply channel 70 penetrating the cover plate 52 in the Y-axis direction (the thickness direction), and at the same time communicated with the ejection channels 54. The liquid supply channel 70 is a specific example corresponding to a "liquid flow hole" in the present disclosure. The liquid supply channel 70 includes a common ink chamber 71 opening on the flow channel plate 41 side in the Y-axis direction, and a plurality of slits 72 each communicated with the common ink chamber 71, and at the same time opening on the actuator plate 51 side in the Y-axis direction. The plurality of slits 72 is disposed at positions corresponding to the plurality of ejection channels 54. The common ink chamber 71 is disposed commonly to the plurality of slits 72, and is communicated with the ejection channels 54 through the plurality of slits 72. The common ink chamber 71 is not communicated with the dummy channels 55.

The common ink chamber 71 is provided to an opposed surface **52*f*2 opposed to the flow channel plate 41 in the cover plate 52. The common ink chamber 71 is disposed at substantially the same position as the tilted surfaces 54*b* of the ejection channels 54 in the Z-axis direction. The common ink chamber 71 is formed to have groove-like shape recessed toward the opposed surface 52*f*1, and at the same time extending in the X-axis direction. It is arranged that the ink inflows into the common ink chamber 71 through the flow channel plate 41**.

The plurality of slits 72 is provided to the opposed surface **52*f*1 opposed to the actuator plate 51. The plurality of slits 72 is arranged at positions each overlapping a part of the common ink chamber 71 in the Y-axis direction. The plurality of slits 72 is communicated with the common ink chamber 71 and the plurality of ejection channels 54. It is desirable for the width in the X-axis direction of each of the slits 72 to substantially the same as the width in the X-axis direction of each of the ejection channels 54**.

It should be noted that it is preferable for the cover plate 52 to be formed of a material having an insulating property, and having thermal conductivity equal to or higher than the thermal conductivity of a material constituting the actuator plate 51. For example, in the case of forming the actuator plate 51 with PZT, it is preferable for the cover plate 52 to be formed of PZT or silicon. This is because thus the difference between the temperature of the cover plate 52 of the head chip 40A and the temperature of the cover plate 52 of the head chip 40B is reduced, and it is possible to achieve the homogenization of the ink temperature inside the inkjet head 4. As a result, the variation in ejection speed of the ink is reduced, and the printing stability is improved.

(Sealing Plate 53)

The sealing plate 53 is a plate-like member having the X-axis direction as the longitudinal direction and the Z-axis direction as the short-side direction, and extending along the X-Z plane similarly to the cover plate 52. The sealing plate 53 has a lower end surface 531 coinciding with the lower end surface 511 of the actuator plate 51 and a lower end surface 521 of the cover plate 52 in the Z-axis direction, and an upper end surface 532 located on an opposite side to the lower end surface 531 in the Z-axis direction. The upper end surface 532 is located at a position retracting from the upper end surface 512 and an upper end surface 522 in the Z-axis direction. The sealing plate 53 further has an opposed surface **53*f*1 opposed to the second surface 51*f*2 of the actuator plate 51. The sealing plate 53 is disposed so that the opposed surface 53*f*1 faces the channel forming region R2 out of the second surface 51*f*2 of the actuator plate 51. Therefore, it is arranged that the plurality of ejection channels 54 and the plurality of dummy channels 55 are closed by the sealing plate 53 and the cover plate 52. The sealing plate 53 is not required to have an opening, a cutout, a groove, or the like. In other words, since it is sufficient for the sealing plate 53** to be a simple rectangular solid, it is possible to use a functional material difficult to fabricate, or a low-price material difficult to obtain high processing accuracy as the constituent material thereof. Therefore, the degree of freedom of selection of a material type is enhanced.

(Arrangement Relationship between Pair of Head Chips 40A, 40B)

As shown in FIG. 3, the pair of head chips 40A, 40B are disposed across the flow channel plate 41 in the Y-axis direction in the state in which the respective opposed surfaces **52*f*2** are opposed to each other in the Y-axis direction.

The ejection channels 54 and the dummy channels 55 of the head chip 40B are arranged so as to be shifted as much as a half pitch in the X-axis direction with respect to the arrangement pitch of the ejection channels 54 and the dummy channels 55 of the head chip 40A. In other words, the ejection channels 54 and the dummy channels 55 of the head chip 40A and the ejection channels 54 and the dummy channels 55 of the head chip 40B are arranged in a zigzag manner.

Therefore, as shown in FIG. 4, the ejection channels 54 of the head chip 40A and the dummy channels 55 of the head chip 40B are opposed to each other in the Y-axis direction. Similarly, as shown in FIG. 5, the dummy channels 55 of the head chip 40A and the ejection channels 54 of the head chip 40B are opposed to each other in the Y-axis direction. It should be noted that the pitch of the ejection channels 54 and the dummy channels 55 in each of the head chips 40A, 40B can arbitrarily be changed.

(Flow Channel Plate 41)

The flow channel plate 41 is sandwiched between the head chip 40A and the head chip 40B in the Y-axis direction. It is preferable for the flow channel plate 41 to integrally formed of the same member. As shown in FIG. 3, the flow channel plate 41 has a rectangular plate-like shape having the X-axis direction as the longitudinal direction, and the Y-axis direction as the short-side direction. When viewed from the Y-axis direction, the outer shape of the flow channel plate 41 is substantially the same as the outer shape of the cover plate 52.

To a principal surface **41*f*1 (a surface facing the head chip 40A) in the Y-axis direction of the flow channel plate 41, there is bonded the opposed surface 52*f*2 in the head chip 40A. To a principal surface 41*f*2 (a surface facing the head chip 40B) in the Y-axis direction of the flow channel plate 41, there is bonded the opposed surface 52*f*2 in the head chip 40**B.

As shown in FIG. 4 and FIG. 5, to the principal surfaces **41*f*1, 41*f*2 of the flow channel plate 41, there are respectively provided entrance flow channels 74 individually communicated with the common ink chamber 71, and exit flow channels 75 individually communicated with circulation channels 76 of the return plate 43**.

As shown in FIG. 3, the exit flow channel 75 is recessed from each of the principal surfaces **41*f*1, 41*f*2 of the flow channel plate 41 inward in the Y-axis direction, and at the same time, recessed from the lower end surface 411 of the flow channel plate 41 toward the upper end surface 412. One end part of each of the exit flow channels 75 opens in the other end surface in the X-axis direction of the flow channel plate 41. Each of the exit flow channels 75 bends downward from the other end surface in the X-axis direction of the flow channel plate 41 so as to have a crank-like shape, and then extends linearly toward the one end side in the X-axis direction. It is preferable for the width in the Z-axis direction of the exit flow channel 75 to be smaller than the width in the Z-axis direction of the entrance flow channel 74 as shown in FIG. 4. Further, the depth in the Y-axis direction of the exit flow channel 75 is substantially the same as the depth in the Y-axis direction of the entrance flow channel 74. The exit flow channels 75 are coupled to an exit manifold (not shown) on the other end surface in the X-axis direction of the flow channel plate 41. The exit manifold is coupled to the ink discharge tube 82 (see FIG. 1**).

(Entrance Manifold 42)

As shown in FIG. 3, the entrance manifold 42 is bonded to one end surfaces in the X-axis direction of the head chips 40A, 40B and the flow channel plate 41. The entrance manifold 42 is provided with a supply channel 77 communicated with the pair of entrance flow channels 74. An end part on the opposite side to the flow channel plate 41 in the supply channel 77 is coupled to the ink supply tube 81 (see FIG. 1).

(Return Plate 43)

The return plate 43 has a rectangular plate-like shape having the X-axis direction as the longitudinal direction, and the Y-axis direction as the short-side direction. The return plate 43 is collectively bonded to the lower end surfaces 511, 521, and 531 of the head chips 40A, 40B and the lower end surface 411 of the flow channel plate 41. In other words, the return plate 43 is disposed on the opening 54K side of each of the ejection channels 54 in the head chip 40A and the head chip 40B. The return plate 43 is a spacer plate intervening between the openings 54K of the ejection channels 54 in the head chip 40A and the head chip 40B, and an upper surface of the nozzle plate 44. The return plate 43 is provided with a plurality of circulation channels 76 for coupling the ejection channels 54 of the head chips 40A, 40B and the exit flow channels 75 to each other. The plurality of circulation channels 76 includes first circulation channels 76*a* and second circulation channels 76*b*. The plurality of circulation channels 76 penetrates the return plate 43 in the Z-axis direction.

(Nozzle Plate 44)

As shown in FIG. 3, an outer shape of the nozzle plate 44 has a rectangular plate-like shape having the X-axis direction as the longitudinal direction, and the Y-axis direction as the short-side direction. The nozzle plate 44 is bonded to a lower end surface of the return plate 43. In the nozzle plate 44, there are arranged a plurality of nozzles 78 (jet holes) penetrating the nozzle plate 44 in the Z-axis direction. The plurality of nozzles 78 includes first nozzles 78*a* and second nozzles 78*b*. The plurality of nozzles 78 penetrates the nozzle plate 44 in the Z-axis direction.

As shown in FIG. 4, in the nozzle plate 44, the first nozzles 78*a* are each formed in a part opposed in the Z-axis direction to the first circulation channel 76*a* of the return plate 43. In other words, the first nozzles 78*a* are arranged on a straight line at intervals in the X-axis direction at the same pitch as that of the first circulation channels 76*a*. The first nozzles 78*a* are each communicated with the first circulation channel 76*a* in an outer end part in the Y-axis direction in the first circulation channel 76*a*. Thus, the first nozzles 78*a* are communicated with the corresponding ejection channels 54 of the head chip 40A via the first circulation channels 76*a*, respectively.

As shown in FIG. 5, in the nozzle plate 44, the second nozzles 78*b* are each formed in a part opposed in the Z-axis direction to the second circulation channel 76*b* of the return plate 43. In other words, the second nozzles 78*b* are arranged on a straight line at intervals in the X-axis direction at the same pitch as that of the second circulation channels 76*b*. The second nozzles 78*b* are each communicated with the second circulation channel 76*b* in an outer end part in the Y-axis direction in the second circulation channel 76*b*. Thus, the second nozzles 78*b* are communicated with the corresponding ejection channels 54 of the head chip 40B via the second circulation channels 76*b*, respectively. The dummy channels 55 are not communicated with the first nozzles 78*a* and the second nozzles 78*b*, and are covered with the return plate 43 from below.

[Method of Manufacturing Inkjet Head 4]

Then, a method of manufacturing the inkjet head 4 will be described. The method of manufacturing the inkjet head 4 according to the present embodiment includes a head chip manufacturing process, a flow channel manufacturing process, a plate bonding process, and a return plate and so on-bonding process. It should be noted that the head chip manufacturing process can be performed by substantially the same methods for the head chip 40A and the head chip 40B. Therefore, in the following description, the head chip manufacturing process in the head chip 40A will be described.

(Head Chip Manufacturing Process)

The head chip manufacturing process in the method of manufacturing the inkjet head 4 according to the present embodiment mainly includes a process related to the actuator plate 51, and a process related to the cover plate 52. Among these processes, the process related to the actuator plate 51 includes, for example, a wafer preparation process, a mask pattern formation process, a channel formation process, and an electrode formation process. Hereinafter, with reference to FIG. 9A through FIG. 9J, the process related mainly to the actuator plate 51 will be described.

Figure 9A:
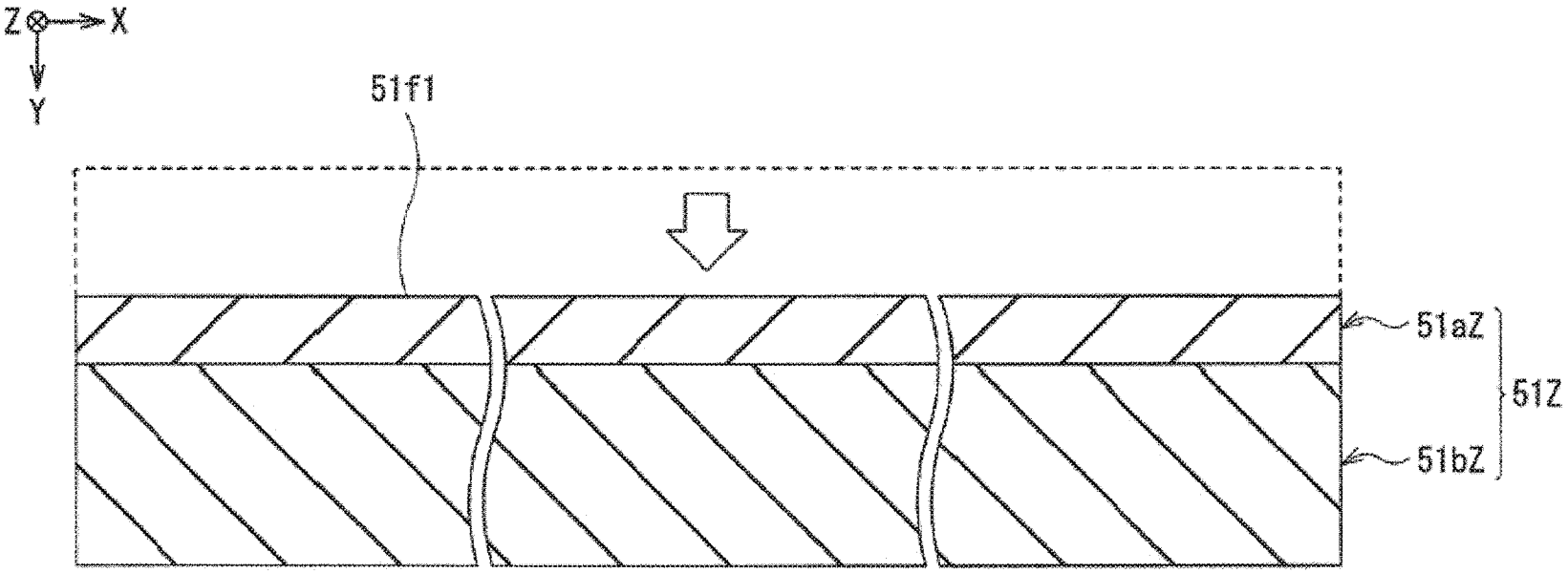
FIG. 9A is a cross-sectional view showing one process of a method of manufacturing the liquid jet head shown in FIG. 1.

In the wafer preparation process, two piezoelectric wafers 51*a*Z, 51*b*Z on which the polarization treatment has been performed in the thickness direction (the Y-axis direction) are prepared, and are stacked on one another so that the polarization directions thereof become opposite to each other as shown in FIG. 9A. Subsequently, grinding work is performed on the piezoelectric wafer 51*a*Z as needed to adjust the thickness of the piezoelectric wafer 51*a*Z. The obverse surface of the piezoelectric wafer 51*a*Z on this occasion becomes the first surface 51*f*1. Thus, the actuator wafer 51Z is formed.

Figure 9B:
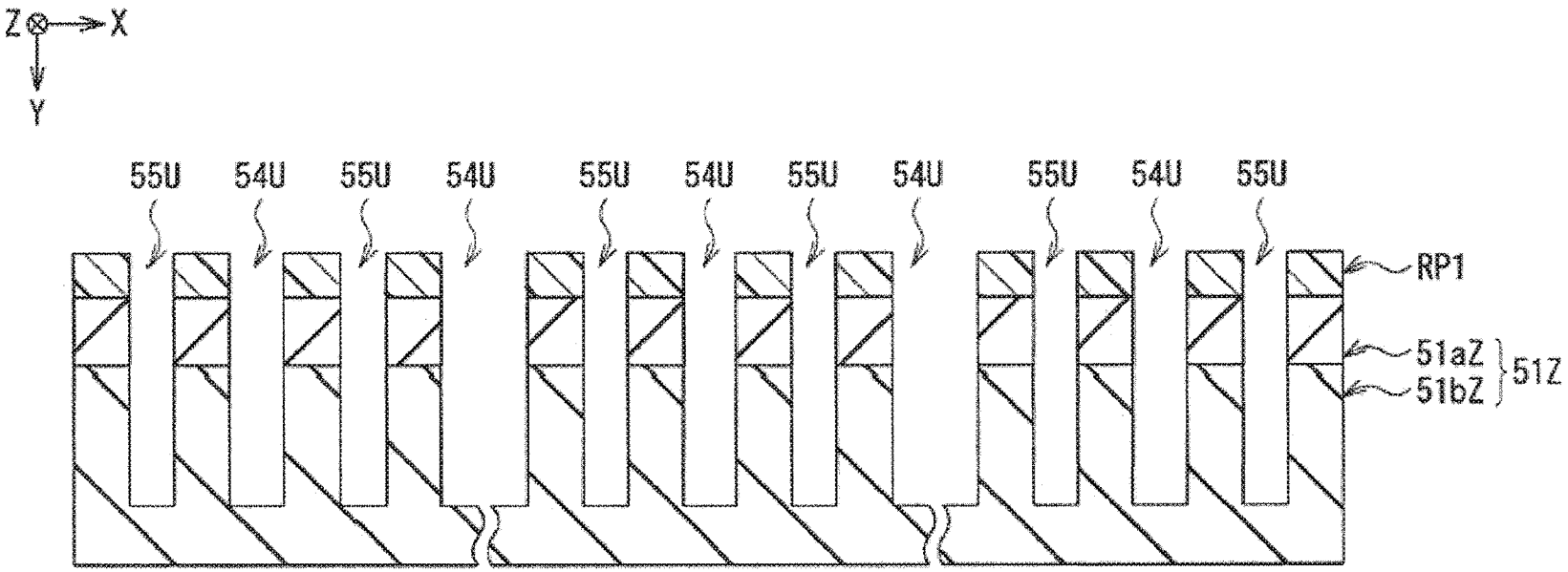
FIG. 9B is a cross-sectional view showing one process following the process shown in FIG. 9A.

Due to the subsequent mask pattern formation process, as shown in FIG. 9B, a resist pattern RP1 to be used as a mask when forming the common electrodes 61 and so on is formed on the first surface 51*f*1 of the actuator wafer 51Z described above. The resist pattern RP1 has a plurality of openings corresponding to the plurality of ejection channels 54 and the plurality of dummy channels 55 at predetermined positions where the plurality of ejection channels 54 and the plurality of dummy channels 55 are to be formed. It should be noted that the resist pattern RP1 can be formed of dry resist, or can also be formed of wet resist.

In the subsequent channel formation process, cutting work is performed from the first surface 51*f*1 of the actuator wafer 51Z described above with a dicing blade not shown or the like. Specifically, by digging down an exposed part which is not covered with the resist pattern RP1 out of the actuator wafer 51Z, a plurality of trenches 54U and a plurality of trenches 55U are formed so as to be arranged in parallel to each other at intervals in the X-axis direction, and at the same time arranged alternately (see FIG. 9B). It should be noted that the trenches 54U and the trenches 55U are parts which turn to the ejection channels 54 and the dummy channels 55 later, respectively.

Figure 9C:
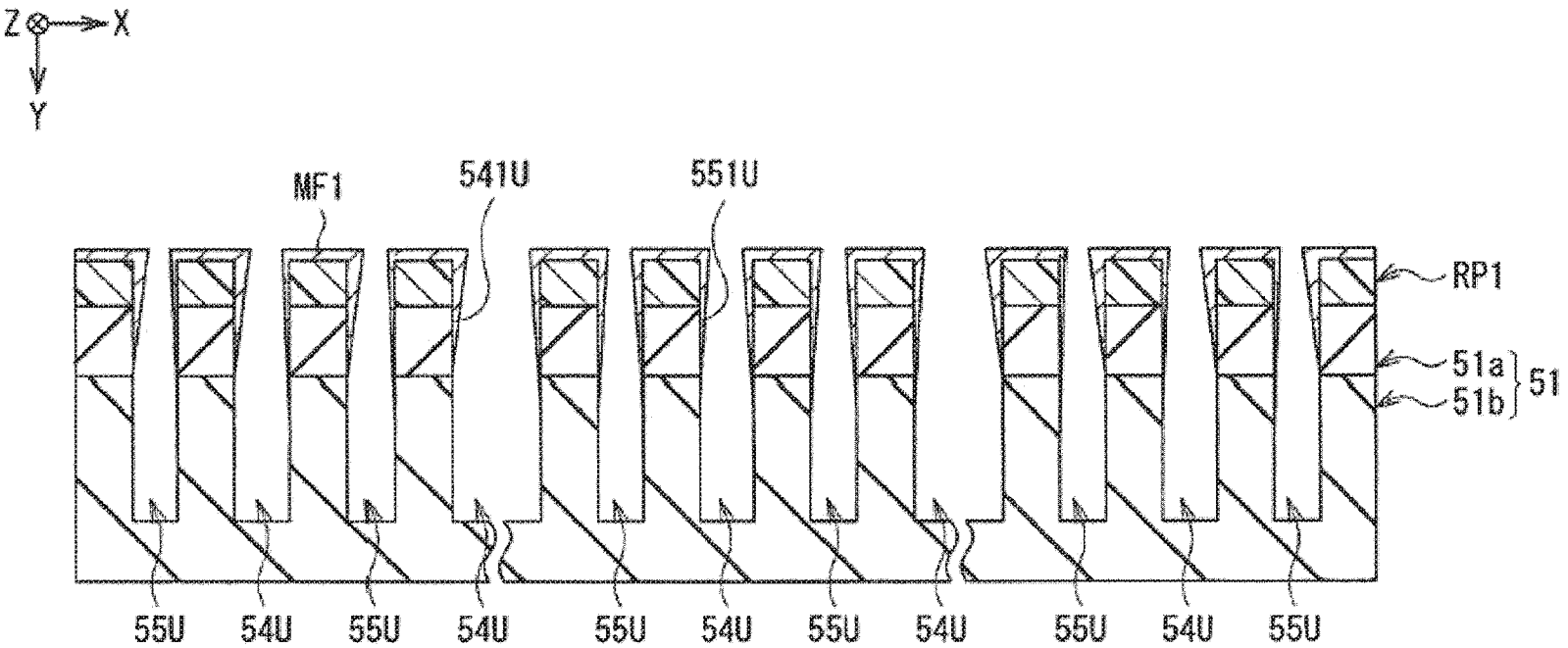
FIG. 9C is a cross-sectional view showing one process following the process shown in FIG. 9B.

In the subsequent first electrode formation process, metal coatings MF1 are formed with, for example, an evaporation method so as to cover inner surfaces 541U of the plurality of trenches 54U, inner surfaces 551U of the plurality of trenches 55U, and the resist pattern RP1 as shown in FIG. 9C. On this occasion, it is preferable to perform oblique vapor deposition for making the constituent material of the metal coating MF1 adhere to the inner surface 541U from an oblique direction to thereby cover the inner surfaces 541U of each of the trenches 54U and the inner surfaces 551U of each of the trenches 55U to positions as deep as possible in the Y-axis direction. It should be noted that it is also possible to perform a descumming treatment for removing residues such as the resist adhering to the inner surfaces 541U of each of the trenches 54U and the inner surfaces 551U of each of the trenches 55U as needed in an anterior stage to the formation of the metal coatings MF1.

Figure 9D:
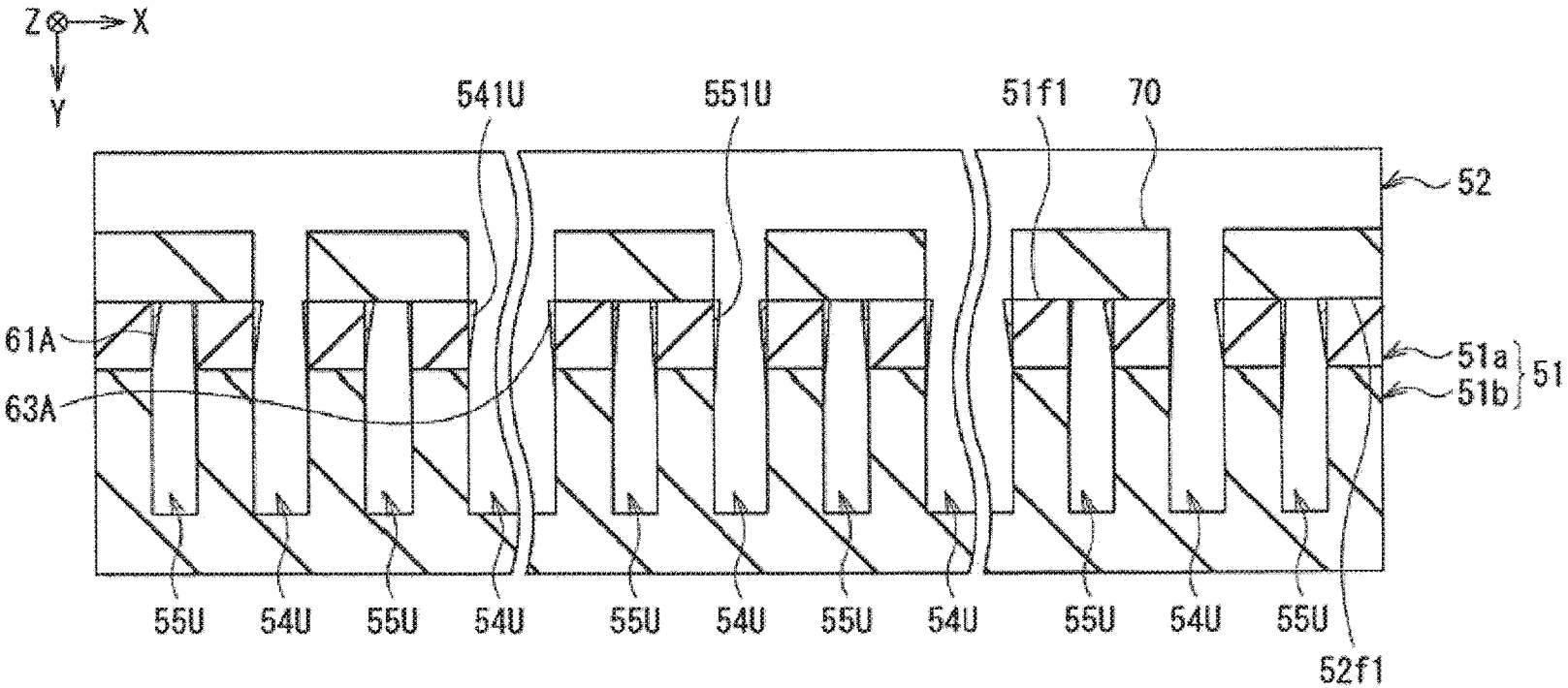
FIG. 9D is a cross-sectional view showing one process following the process shown in FIG. 9C.

Subsequently, the resist pattern RP1 is removed to thereby expose the first surface 51*f*1 of the actuator wafer 51Z, and then, the cover plate 52 is bonded so that the opposed surface 52*f*1 overlaps the first surface 51*f*1 as shown in FIG. 9D. On that occasion, the opposed surface 52*f*1 of the cover plate 52 is bonded to the first surface 51*f*1 so that the liquid supply channel 70 is opposed to the ejection channels 54. Here, by removing the resist pattern RP1, there remain only the parts covering the inner surfaces 541U of the trenches 54U and the inner surfaces 551U of the trenches 55U out of the metal coatings MF1. As a result, the first common electrode part 61A is formed on each of the inner surfaces 541U of the trenches 54U, and the first individual electrode part 63A is formed on each of the inner surfaces 551U of the trenches 55U.

Figure 9E:
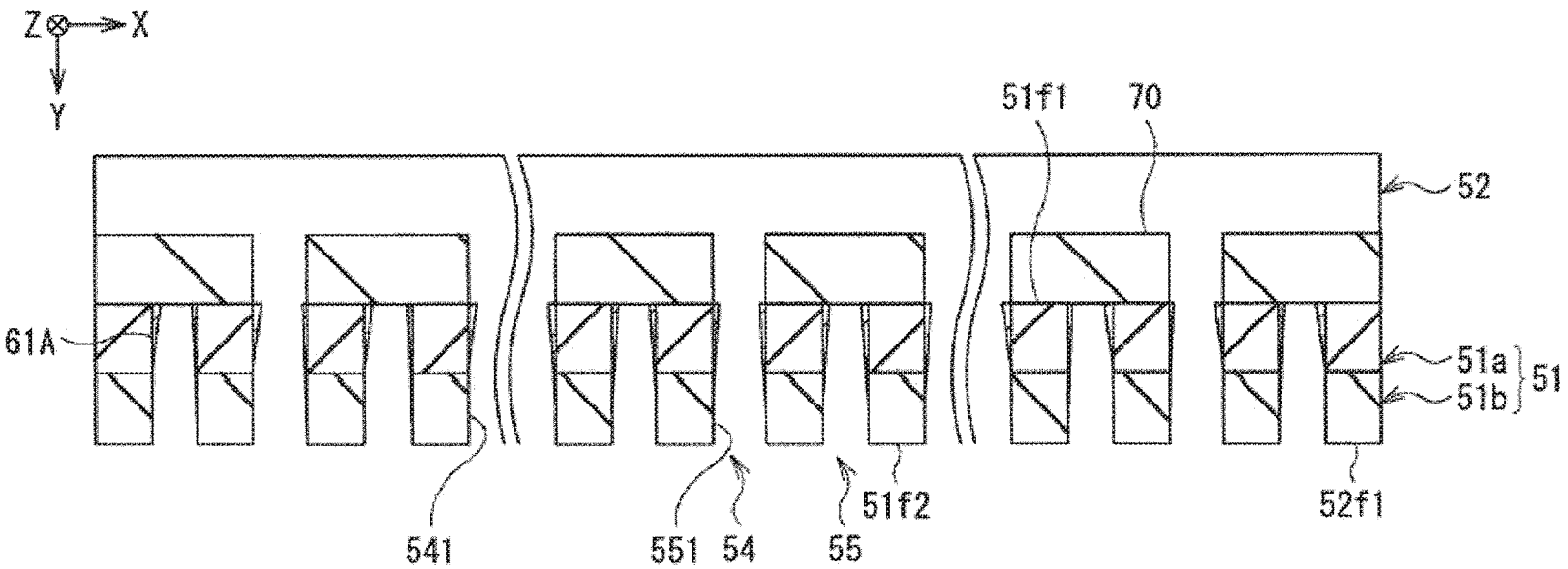
FIG. 9E is a cross-sectional view showing one process following the process shown in FIG. 9D.

Then, as shown in FIG. 9E, the grinding work is performed on the piezoelectric wafer 51*b*Z from a reverse surface (a surface on the opposite side to the piezoelectric wafer 51*a*Z) to adjust the thickness of the piezoelectric wafer 51*b*Z. On that occasion, the plurality of ejection channels 54 and the plurality of dummy channels 55 are exposed. The reverse surface of the piezoelectric wafer 51*b*Z on this occasion becomes the second surface 51*f*2. Thus, a so-called chevron type actuator plate 51 is formed.

Figure 9F:
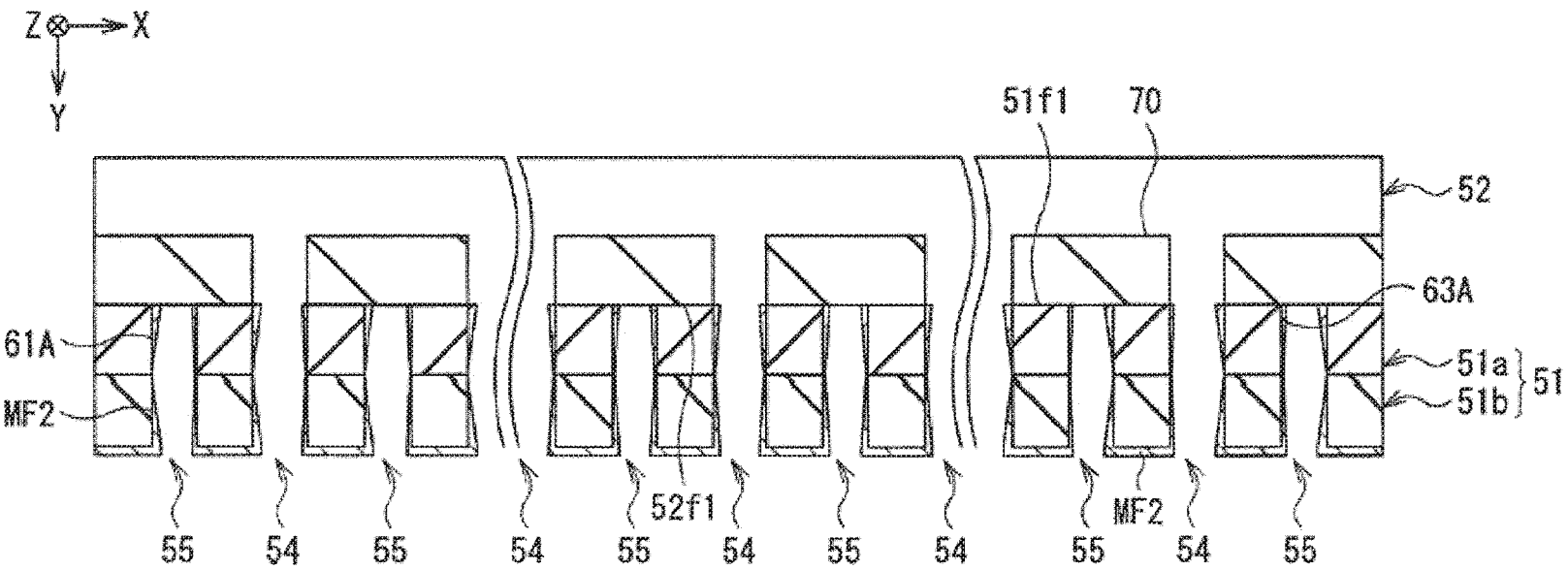
FIG. 9F is a cross-sectional view showing one process following the process shown in FIG. 9E.

In the subsequent second electrode formation process, metal coatings MF2 covering the inner surfaces 541 of the plurality of ejection channels 54 and the inner surfaces 551 of the plurality of dummy channels 55 are formed with, for example, an evaporation method as shown in FIG. 9F. On this occasion, it is preferable to arrange that the metal coating MF2 has contact with the first common electrode part 61A or the first individual electrode part 63A, or a part of the metal coating MF2 overlaps a part of the first common electrode part 61A or the first individual electrode part 63A.

Figure 9G:
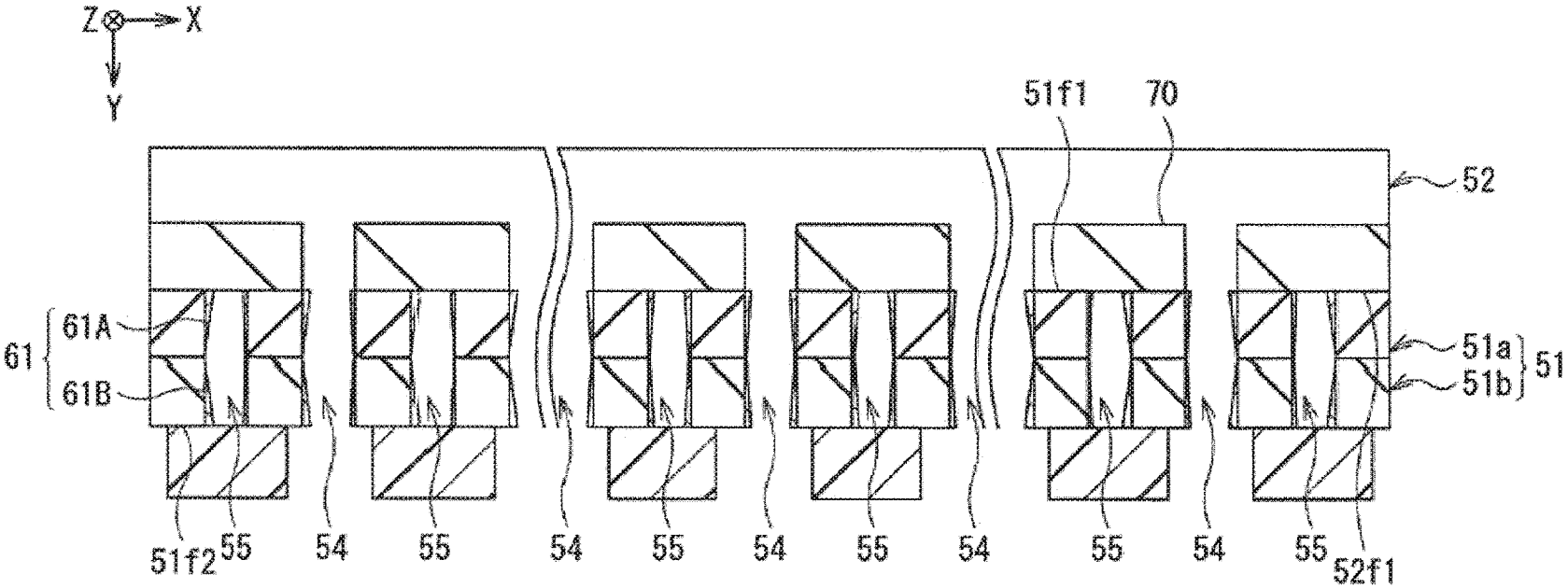
FIG. 9G is a cross-sectional view showing one process following the process shown in FIG. 9F.

Then, as shown in FIG. 9G, the part covering the second surface 51*f*2 out of the metal coating MF2 is selectively removed to thereby expose the second surface 51*f*2, and then, a resist pattern RP2 is selectively formed on the second surface 51*f*2. Here, by selectively removing the part covering the second surface 51*f*2 out of the metal coatings MF2, there remain only the parts covering the inner surfaces 541 of the ejection channels 54 and the inner surfaces 551 of the dummy channels 55 out of the metal coatings MF2. As a result, the second common electrode part 61B is formed on each of the inner surfaces 541 of the ejection channels 54, and the second individual electrode part 63B is formed on each of the inner surfaces 551 of the dummy channels 55. As a result, the common electrodes 61 and the individual electrodes 63 are formed.

Figure 9H:
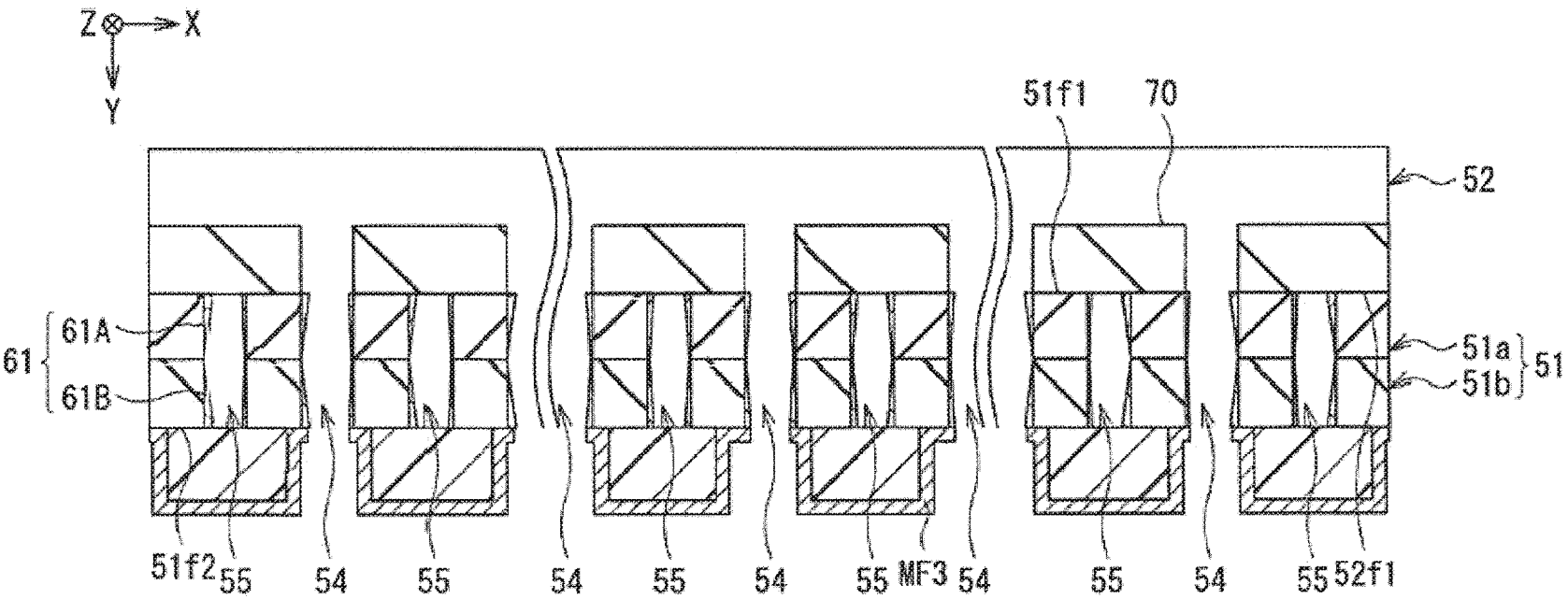
FIG. 9H is a cross-sectional view showing one process following the process shown in FIG. 9G.

Subsequently, as shown in FIG. 9H, metal coatings MF3 are formed using, for example, an evaporation method so as to cover the second surface 51*f*2 and the resist pattern RP2 as the third electrode formation process. On this occasion, it is preferable to arrange that the metal coating MF3 has contact with the second common electrode part 61B or the second individual electrode part 63B, or a part of the metal coating MF3 overlaps a part of the second common electrode part 61B or the second individual electrode part 63B.

Figure 9I:
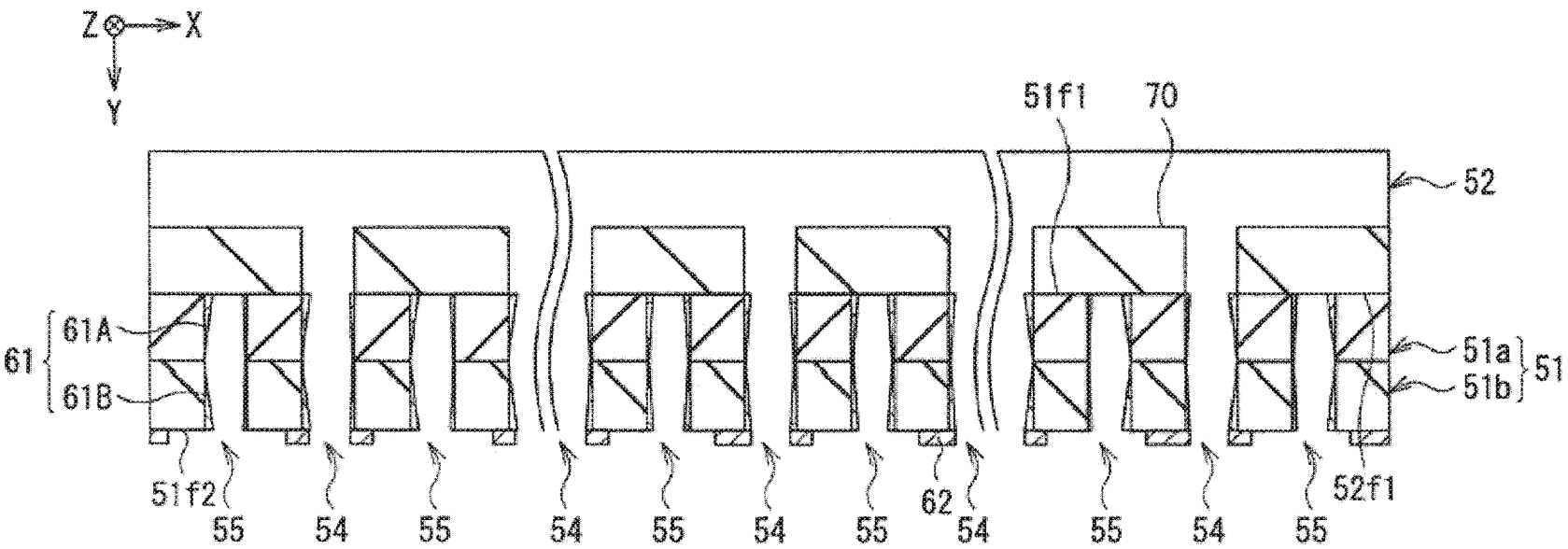
FIG. 9I is a cross-sectional view showing one process following the process shown in FIG. 9H.

Then, as shown in FIG. 9I, by removing the resist pattern RP2, some parts of the metal coatings MF3 remain on the second surface 51*f*2 to form the common electrode pads 62 and the individual electrode pads 64 (not appearing in FIG. 9I).

Figure 9J:
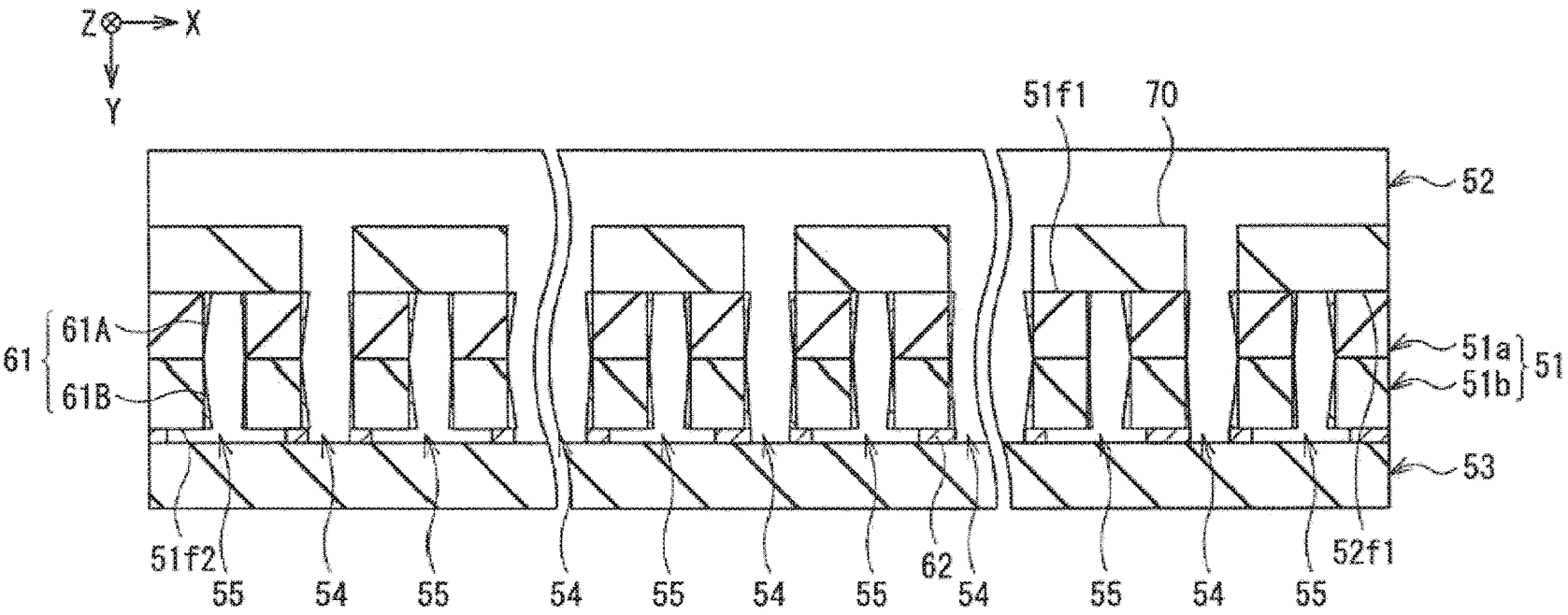
FIG. 9J is a cross-sectional view showing one process following the process shown in FIG. 9I.

Lastly, as shown in FIG. 9J, by bonding the opposed surface 53*f*1 of the sealing plate 53 to the second surface 51*f*2, the actuator plate 51 and the sealing plate 53 are bonded to each other. According to the above, manufacturing of the head chip 40A is completed. The head chip 40B can also be manufactured in a similar manner.

Figure 10:
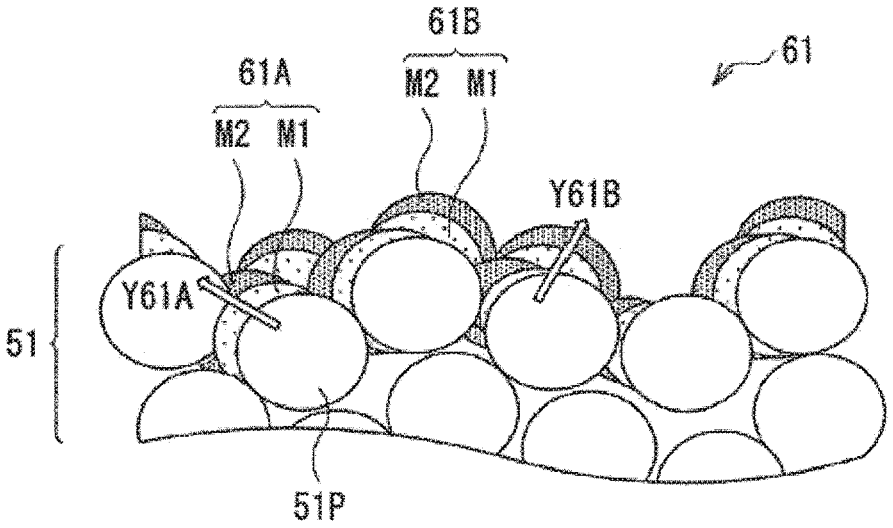
FIG. 10 is a cross-sectional view showing, in an enlarged manner, the actuator plate shown in FIG. 3.

Here, in the common electrode 61, for example, it is preferable for each of the first common electrode part 61A and the second common electrode part 61B to include a double-layered structure consisting of first metal M1 for covering the inner surface 541 of the ejection channel 54 and second metal M2 for covering the first metal M1 as shown in FIG. 10. FIG. 10 is a schematic cross-sectional view showing the vicinity of the boundary between the inner surface 541 of the ejection channel 54 and the common electrode 61 in an enlarged manner. For example, the actuator plate 51 has a plurality of particles 51P sintered with each other, and the first metal M1 and the second metal M2 are stacked in sequence on the surface of the particle 51P. When forming the first common electrode part 61A, firstly the first metal M1 is formed on the surface of the particle 51P constituting the inner surface 541 using the oblique vapor deposition, and then the second metal M2 is formed on the surface of the first metal M1 using the oblique vapor deposition. When forming the second common electrode part 61B, firstly the first metal M1 is formed on the surface of the particle 51P or the first common electrode part 61A using the oblique vapor deposition, and then the second metal M2 is formed on the surface of the first metal M1 using the oblique vapor deposition. Here, the first common electrode part 61A is formed using the oblique vapor deposition from the first surface 51*f*1 side of the actuator plate 51, while the second common electrode part 61B is formed using the oblique vapor deposition from the second surface 51*f*2 side of the actuator plate 51. Therefore, it results in that a stacking direction Y61A of the first metal M1 and the second metal M2 with respect to the particle 51P in the first common electrode part 61A and a stacking direction Y61B of the first metal M1 and the second metal M2 with respect to the particle 51P in the second common electrode part 61B are different from each other. In the present embodiment, it is preferable to make, for example, a second vapor deposition angle when performing the oblique vapor deposition of the second common electrode part 61B from the second surface 51*f*2 side larger than a first vapor deposition angle when performing the oblique vapor deposition of the first common electrode part 61A from the first surface 51*f*1 side. This is because, when forming the second common electrode part 61B, it is possible to decrease the second common electrode part 61B (the metal coating MF2) adhering to the second surface 51*f*2 without decreasing the second common electrode part 61B (the metal coating MF2) adhering to the inner surface 541 of the ejection channel 54. It should be noted that similarly to the common electrodes 61, regarding the individual electrodes 63, it is preferable to include the double-layered structure consisting of the first metal M1 and the second metal M2 shown in FIG. 10.

Figure 11:
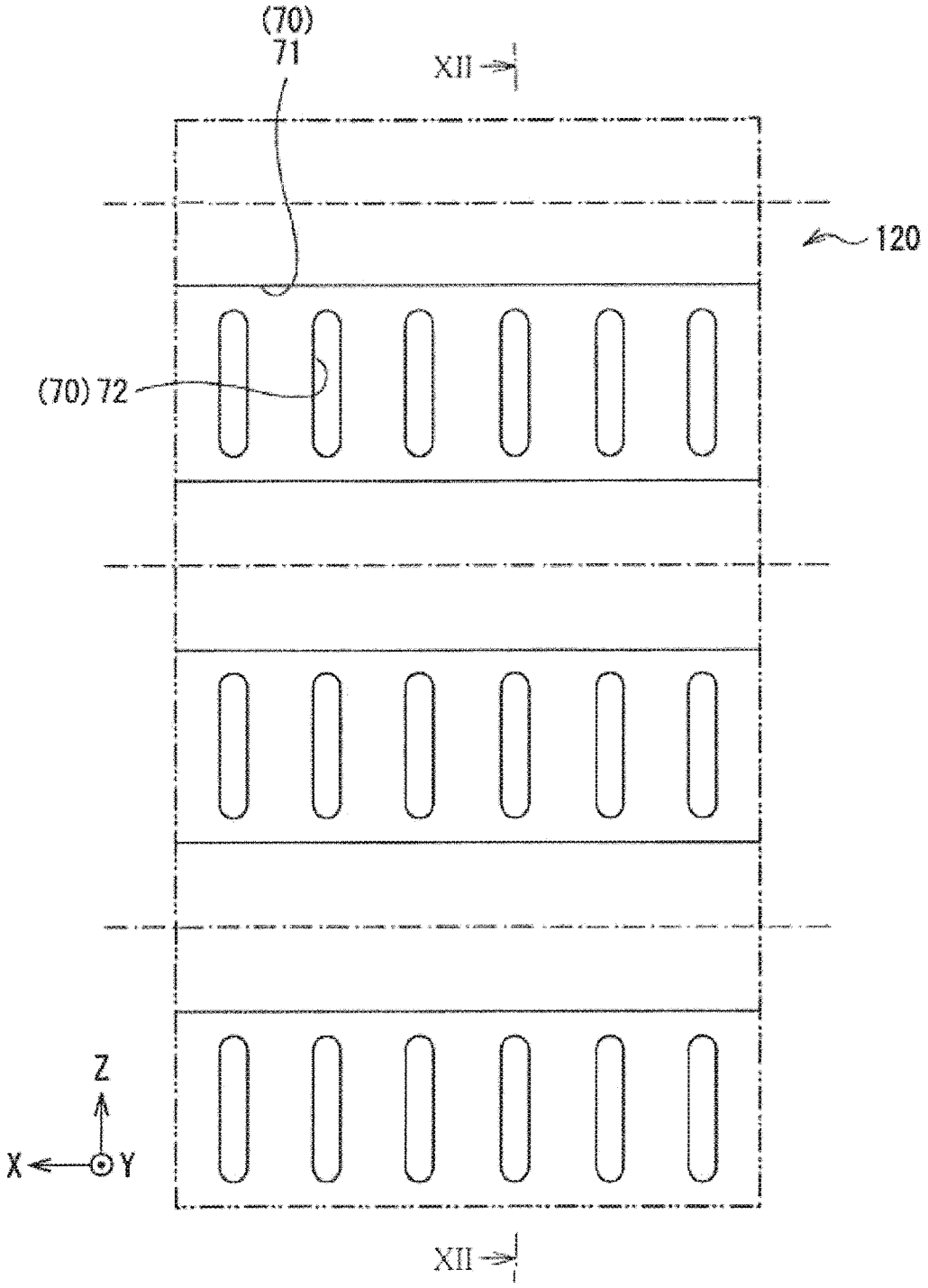
FIG. 11 is a plan view showing one process for forming the cover plate included in the method of manufacturing the liquid jet head shown in FIG. 1.
Figure 12:
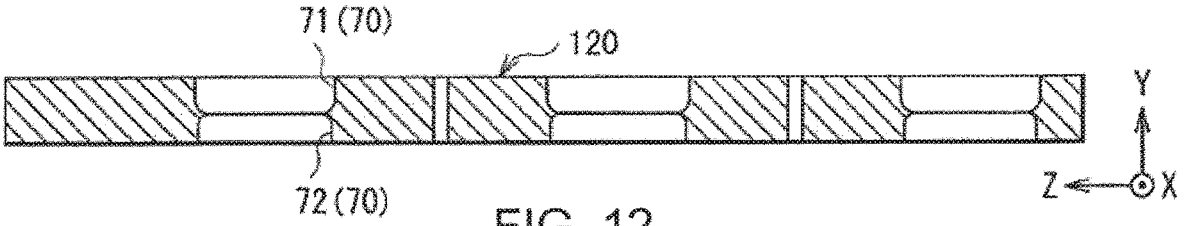
FIG. 12 is a cross-sectional view showing one process following the process shown in FIG. 11.

Here, the process related to the cover plate 52 will be described with reference mainly to FIG. 11 and FIG. 12. FIG. 11 is a plan view showing a formation process of the common ink chamber 71, and FIG. 12 is a cross-sectional view showing a formation process of the slits 72 following the process shown in FIG. 11. It should be noted that FIG. 12 shows a cross-sectional surface in the arrow direction along the cutting line XII-XII shown in FIG. 11.

As shown in FIG. 11, in the formation process of the common ink chamber 71, firstly, sandblasting or the like is performed on a cover wafer 120 prepared from the obverse surface side through a mask not shown to form the common ink chamber 71. Subsequently, as shown in FIG. 12, in the slit formation process, sandblasting or the like is performed on the cover wafer 120 from the reverse surface side through a mask not shown to form the slits 72 individually communicated with the common ink chamber 71. It should be noted that each of the formation process of the common ink chamber 71 and the formation process of the slits 72 is not limited to sandblasting, but can also be performed using dicing, cutting, or the like. Lastly, the cover wafer 120 is segmentalized along the dashed-dotted lines extending in the X-axis direction shown in FIG. 11. Thus, the cover plate 52 is completed.

(Flow Channel Plate Manufacturing Process)

The flow channel manufacturing process in the method of manufacturing the inkjet head 4 according to the present embodiment includes a flow channel formation process and a segmentalizing process.

Figure 13:
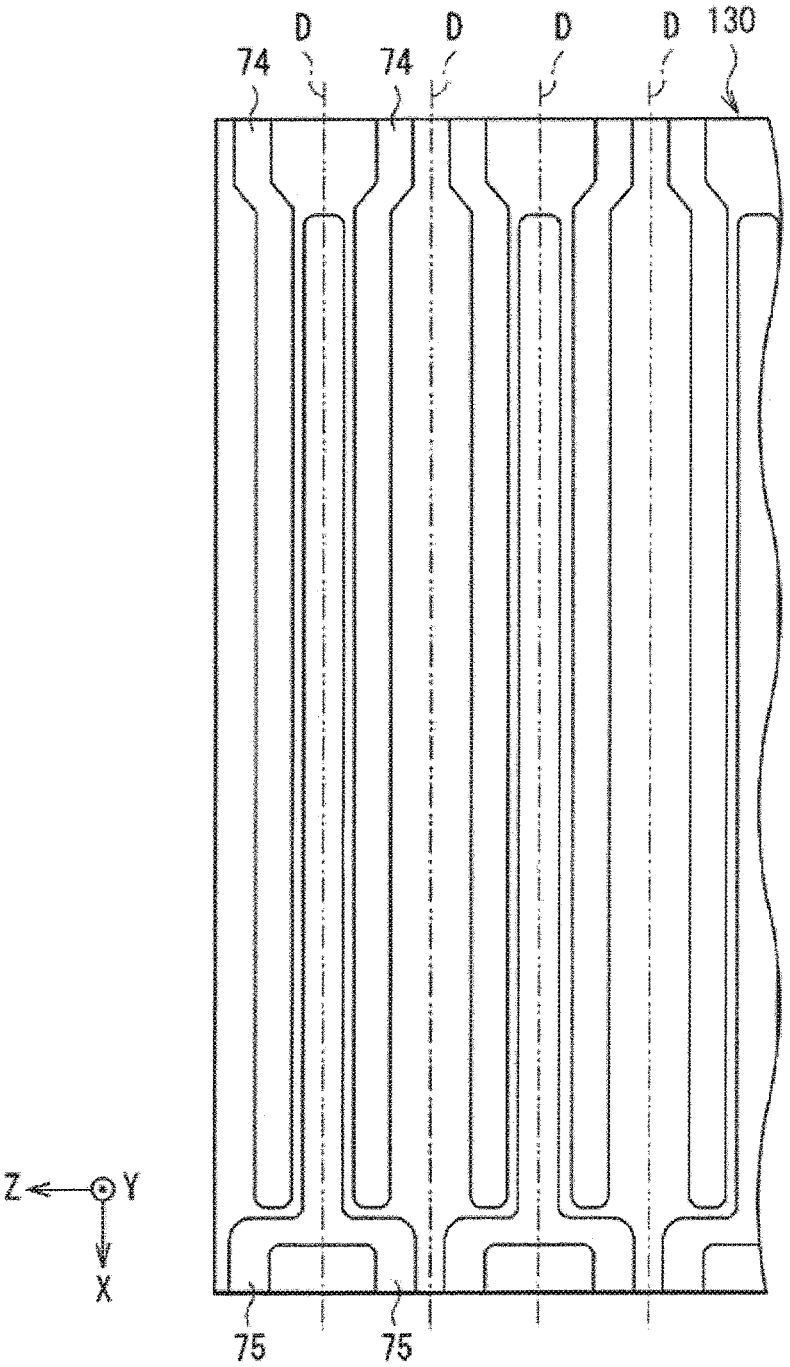
FIG. 13 is a plan view showing a process of manufacturing a flow channel plate included in the method of manufacturing the liquid jet head shown in FIG. 1.

FIG. 13 is a plan view showing the flow channel plate manufacturing process. As shown in FIG. 13, in the flow channel formation process, firstly, sandblasting or the like is performed on a flow channel wafer 130 from the obverse surface side through a mask not shown to form each of the entrance flow channels 74 on the obverse surface side and the exit flow channels 75 on the obverse surface side.

In addition, in the flow channel formation process, sandblasting or the like is performed on the flow channel wafer 130 from the reverse surface side through a mask not shown to form the entrance flow channels 74 on the reverse surface side and the exit flow channels 75 on the reverse surface side. It should be noted that each process in the flow channel formation process is not limited to sandblasting, but can also be performed using dicing, cutting, or the like.

In the segmentalizing process following the flow channel formation process, the flow channel wafer 130 is segmentalized along the axis lines (the imaginary lines D shown in FIG. 13) of straight line parts in the X-axis direction in the exit flow channels 75 using a dicer or the like. Thus, the flow channel plate 41 (see FIG. 3) is completed.

(Various-Plate Bonding Process)

As shown in FIG. 3, in the various-plate bonding process, each of the cover plate 52 of the head chip 40A and the cover plate 52 of the head chip 40B is bonded to the flow channel plate 41. Specifically, the principal surface 41/1 of the flow channel plate 41 is bonded to the opposed surface 52/2 of the head chip 40A, and at the same time, the principal surface 41/2 of the flow channel plate 41 is bonded to the opposed surface 52/2 of the head chip 40B. Thus, a plate bonded body is manufactured. It should be noted that it is also possible to arrange that the plate bonded body obtained by sequentially bonding the cover plate 52 of the head chip 40A and the cover plate 52 of the head chip 40B to each other is manufactured by bonding one cover wafer 120 to each of the both surfaces of the flow channel wafer 130, and then performing chip separation (segmentalization).

(Return Plate and so On-Bonding Process)

Subsequently, the return plate 43 and the nozzle plate 44 are bonded to the plate bonded body described above. Subsequently, the external wiring board 45 is mounted on the common electrode pads 62 and the individual electrode pads 64 (see FIG. 4, FIG. 5).

According to the above, the inkjet head 4 according to the present embodiment is completed.

Operations and Functions/Advantages (A. Basic Operation of Printer 1)

In the printer 1, the recording operation (a printing operation) of images, characters, and so on to the recording paper P is performed in the following manner. It should be noted that as an initial state, it is assumed that the four types of ink tanks 3 (3Y, 3M, 3C, and 3K) shown in FIG. 1 are sufficiently filled with the ink of the corresponding colors (the four colors), respectively. Further, there is achieved the state in which the inkjet heads 4 are filled with the ink in the ink tanks 3 via the ink circulation mechanism 8, respectively. More specifically, there is achieved the state in which a predetermined amount of ink is supplied to the head chips 40 via the ink supply tube 81 and the flow channel plate 41 to fill the ejection channels 54 via the liquid supply channels 70.

In such an initial state, when operating the printer 1, the grit rollers 21 in the carrying mechanisms 2*a*, 2*b* each rotate to thereby carry the recording paper P along the carrying direction d (the X-axis direction) while being held between the grit rollers 21 and the pinch rollers 22. Further, at the same time as such a carrying operation, the drive motor 38 in the drive mechanism 34 rotates each of the pulleys 35, 36 to thereby operate the endless belt 37. Thus, the carriage 33 reciprocates along the width direction (the Y-axis direction) of the recording paper P while being guided by the guide rails 31, 32. Then, on this occasion, the four colors of ink are appropriately ejected on the recording paper P by the respective inkjet heads 4 (4Y, 4M, 4C, and 4K) to thereby perform the recording operation of images, characters, and so on to the recording paper P.

(B. Detailed Operation in Inkjet Head 4)

Then, the detailed operation (the jet operation of the ink) in the inkjet head 4 will be described with reference to FIG. 1 through FIG. 8. Specifically, in the inkjet head 4 (edge-shoot type) according to the present embodiment, the jet operation of the ink using a shear mode is performed in the following manner. It should be noted that the following jet operation is performed by a drive circuit (not shown) mounted on the inkjet head 4.

In such an inkjet head 4 which is the edge-shoot type, and is the circulation type as in the present embodiment, firstly, the pressure pump 84 and the suction pump 85 shown in FIG. 2 are operated to thereby make the ink flow through the circulation flow channel 83. On this occasion, the ink flowing through the ink supply tube 81 passes through the supply channel 77 of the entrance manifold 42 shown in FIG. 3, and inflows into the entrance flow channels 74 of the flow channel plate 41. The ink having flowed into the entrance flow channels 74 passes through the common ink chambers 71, and is then supplied to the ejection channels 54 through the slits 72. The ink having flowed into the ejection channels 54 reaggregates in the exit flow channels 75 via the circulation channels 76 of the return plate 43, then passes through the exit manifold, and is then discharged to the ink discharge tube 82 shown in FIG. 2. The ink discharged to the ink discharge tube 82 is returned to the ink tank 3, and is then supplied to the ink supply tube 81 again. Thus, the ink is circulated between the inkjet head 4 and the ink tank 3.

Then, when the reciprocation is started by the carriage 33 (see FIG. 1), drive voltages are applied between the common electrodes 61 and the individual electrodes 63 via the external wiring board 45. On this occasion, for example, the individual electrode 63 is set to a drive potential Vdd, and the common electrode 61 is set to a reference potential GND. When applying the drive voltage between the common electrode 61 and the individual electrode 63, a thickness-shear deformation occurs in the two drive walls 56 for defining the ejection channel 54, and the two drive walls 56 deform so as to protrude toward the dummy channels 55. Specifically, since the actuator plate 51 has a structure in which the two piezoelectric substrates 51*a*, 51*b* on which the polarization treatment has been performed in the thickness direction (the Y-axis direction) are stacked on one another, by applying the drive voltage described above, the actuator plate 51 makes a flexural deformation to have a V-shape centered on the intermediate position in the Y-axis direction in the drive walls 56. Thus, the ejection channel 54 deforms as if it bulges.

When the capacity of the ejection channel 54 increases due to the deformation of the two drive walls 56 defining the ejection channel 54, the ink in the common ink chamber 71 is induced into the ejection channel 54 through the slit 72. Then, the ink having been induced into the ejection channel 54 propagates inside the ejection channel 54 as a pressure wave. The drive voltage between the common electrode 61 and the individual electrode 63 is vanished at the timing at which the pressure wave has reached the nozzle 78. Thus, the shapes of the two drive walls 56 are restored, and the capacity of the ejection channel 54 having once increased is restored to the original capacity. Due to this operation, the internal pressure of the ejection channel 54 increases to pressurize the ink in the ejection channel 54. As a result, it is possible to eject the ink from the nozzle 78. On this occasion, the ink becomes an ink droplet having a droplet shape when passing through the nozzle 78, and is then ejected. Thus, it is possible to record characters, images, and the like on the recording paper P as described above.

It should be noted that the operation method of the inkjet head 4 is not limited to the content described above. For example, it is also possible to adopt a configuration in which the drive walls 56 in the normal state are deformed toward the inside of the ejection channel 54 as if the ejection channel 54 gives inward. This case can be realized by setting the drive voltage to be applied between the common electrode 61 and the individual electrode 63 to the voltage having an opposite polarity to that of the voltage described above, or by reversing the polarization direction of the actuator plate 51 without changing the polarity of the voltage. Further, it is also possible to deform the ejection channel 54 so as to bulge outward, and then deform the ejection channel 54 so as to give inward to thereby increase the pressurizing force of the ink when ejecting the ink.

(C. Functions/Advantages)

Then, the functions and the advantages in the head chips 40, the inkjet head 4, and the printer 1 according to the present embodiment will be described in detail.

In the head chips 40 according to the present embodiment, the common electrodes 61 each have the first common electrode part 61A covering the inner surface 541 of the ejection channel 54 continuously from the first surface 51*f*1 toward the second surface 51*f*2, and the second common electrode part 61B covering the inner surface 541 of the ejection channel 54 continuously from the second surface 51*f*2 toward the first surface 51*f*1. Therefore, it is possible to form the first common electrode part 61A by the evaporation from the first surface 51*f*1 side, and the second common electrode part 61B by the evaporation from the second surface 51*f*2 side. Therefore, compared to the case of forming the common electrode 61 from only either one of the first surface 51*f*1 side and the second surface 51*f*2 side, it is possible to cover the inner surfaces 541 continuously from the first surface 51*f*1 to the second surface 51*f*2 even in the case in which the plurality of ejection channels 54 each has a high aspect ratio. Therefore, the variation in the area of the common electrode 61 to be provided to the plurality of ejection channels 54 is reduced, and thus, it is possible to reduce the variation in ejection amount of the ink and the ejection speed of the ink from the ejection channel 54.

Further, since it is arranged that the first common electrode part 61A is evaporated from the first surface 51*f*1 side, and the second common electrode part 61B is evaporated from the second surface 51*f*2 side, it is possible to homogenize each of the film quality of the first common electrode part 61A and the film quality of the second common electrode part 61B, and it is possible to suppress the degradation of the film quality as a whole in the common electrode 61.

Further, since the variation in the area of the common electrode 61 to be formed in the plurality of ejection channels 54 is reduced, the variation in the capacitance in the head chip 40 is reduced, and thus, the variation in temperature in the head chip 40 when ejecting the ink is reduced. As a result, the controllability by the temperature sensor is improved, and it is possible to reduce the variation in ejection amount of the ink and ejection speed of the ink from the ejection channel 54.

In contrast, if the common electrodes 61 are formed by the evaporation only from, for example, the first surface 51*f*1 side, it results in that the film thickness of the common electrode 61 in the vicinity of the second surface 51*f*2 becomes thinner compared to the film thickness of the common electrode 61 in the vicinity of the first surface 51*f*1, or that the common electrode 61 is not at all formed in the vicinity of the second surface 51*f*2. The same applies to the case of forming the common electrodes 61 by the evaporation only from the second surface 51*f*2 side. Therefore, in such cases, there is a possibility that the operation of the actuator plate 51 becomes unstable, and thus, the variation in ejection speed of the ink and ejection amount of the ink increases. Further, in the case of evaporating the common electrodes 61 only from one surface side, due to the influence of the relationship between the principle of the oblique vapor deposition and the aspect ratio, and the surface roughness of the particles of PZT constituting the actuator plate 51, it is difficult to homogenize the area of the common electrode 61, and there is a possibility that a lack of the operation stability as the head chip 40 occurs to cause the variation in ejection amount of the ink and ejection speed of the ink. Further, in the case in which the common electrode 61 partially includes an extremely thin part, there is a possibility that the extremely thin part fails to function as the drive electrode. For example, since the extremely thin part is remarkably high in resistance value or hardly conductive, there is a possibility that it fails to follow the applied voltage with a desired operation frequency. It should be noted that in the case in which such a thin part exists at the same position in the common electrodes 61 in all of the ejection channels 54, and has the same thickness, it results in that the variation in operation between the ejection channels 54 does not occur, but it is practically difficult to form such a thin part at the same position with the same thickness in all of the ejection channels 54 as described above. Further, in the case of the structure in which the common electrode 61 is coupled to the external wiring board 45 in the second surface 51/2, if the part which fails to function as the electrode exists as a part of the common electrode 61, it results in that the operation stability is damaged. In contrast, in the head chips 40 according to the present embodiment, since it is arranged that the first common electrode part 61A is evaporated from the first surface 51/1 side, and at the same time, the second common electrode part 61B is evaporated from the second surface 51/2 side, it is possible to suppress the degradation of the film quality as a whole in the common electrode 61, and thus, such a problem as described above is solved.

Further, in the present embodiment, since the actuator plate 51 has the chevron-type stacked structure, the following technical advantages can be expected. In the present embodiment, it is arranged that the common electrode 61 covers the inner surface 541 of the ejection channel 54 continuously from the first surface 51/1 to the second surface 51/2 in the thickness direction (the Y-axis direction) of the actuator plate 51. Therefore, it is possible to increase the area of the common electrode 61 compared to the case of forming the common electrode 61 from only either one of the first surface 51/1 side and the second surface 51/2 side. Therefore, it is possible to lower the drive voltage of the common electrode 61 to achieve reduction of power consumption and suppression of rise in temperature of the head chip.

Specifically, the reason is as follows. In the case of obtaining a predetermined deformation amount of the drive walls 56, the drive voltage of the chevron-type actuator plate 51 can be lowered to a level lower than the drive voltage of the monopole substrate. In order to maximize the advantage of such a chevron-type actuator plate 51, namely the reduction effect of the drive voltage, it is necessary to form the common electrode 61 covering the inner surface 541 of the ejection channel 54 continuously from the first surface 51/1 to the second surface 51/2. Some effect can be expected even if the common electrode 61 does not spread in the whole of the inner surface 541 of the ejection channel 54. However, the chevron-type actuator plate 51 is more easily affected by (higher in degree of influence of) the area of the electrode than the monopole substrate, and is easily affected by the variation in ejection amount of the ink and the variation in ejection speed of the ink as a result. Incidentally, it is extremely difficult to reduce the variation in electrode area of the inner surface 541 between the plurality of ejection channels 54 using the oblique vapor deposition unless the inner surface 541 of the ejection channel 54 is covered continuously from the first surface 51/1 to the second surface 51/2. Therefore, by arranging that the inner surface 541 of the ejection channel 54 is covered continuously from the first surface 51/1 to the second surface 51/2, it is possible to maximize the advantage of the chevron-type actuator plate 51. In other words, by the chevron-type actuator plate 51 having the common electrodes 61 each covering the inner surface 541 of the ejection channel 54 continuously from the first surface 51/1 to the second surface 51/2, it is possible to sufficiently lower the drive voltage compared to the case of using the monopole substrate, or the case in which the common electrode 61 is formed so as not to cover the inner surface 541 continuously from the first surface 51/1 to the second surface 51/2 even in the case of using the chevron-type substrate. As a result, the power consumption is reduced to reduce the heat generation, and thus, the rise in temperature of the head chip 40 can be suppressed.

Further, in the present embodiment, as described above, there is adopted the structure in which the first common electrode part 61A out of the common electrode 61 can be formed by the evaporation from the first surface 51/1 side, and at the same time, the second common electrode part 61B can be formed by the evaporation from the second surface 51/2 side. By the first common electrode part 61A and the second common electrode part 61B having such a film thickness distribution partially overlapping each other, the variation in film thickness of the common electrode 61 in the thickness direction (the Y-axis direction) of the actuator plate 51 is reduced. Therefore, the variation in resistance value between the common electrodes 61 provided to the plurality of ejection channels 54 is reduced, and thus, the variation in heat generation amount between the common electrodes 61 provided to the plurality of ejection channels 54 is reduced. As a result, the variation in the temperature of the ink supplied to the plurality of ejection channels 54, namely the viscosity of the ink is reduced, and the variation in ejection speed of the ink and ejection amount of the ink is reduced.

Further, in the present embodiment, it is arranged that the first common electrode part 61A and the second common electrode part 61B each include a double-layered structure consisting of the first metal M1 for covering the inner surface 541 of the ejection channel 54 and the second metal M2 for covering the first metal M1. Therefore, an improvement of the functions provided to the first common electrode part 61A and the second common electrode 61B can be achieved. For example, by adopting a material excellent in adhesiveness to the inner surface 541 of the ejection channels 54 such as Ti (titanium) as the first metal M1, and adopting a low-resistance material such as Au (gold) as the second metal M2, power saving as the head chips 40 is realized while increasing the mechanical strength of the common electrode 61.

Further, in the present embodiment, the actuator plate 51 has a plurality of particles 51P sintered, and a stacking direction Y61A of the first metal M1 and the second metal M2 with respect to the particle 51P in the first common electrode part 61A and a stacking direction Y61B of the first metal M1 and the second metal M2 with respect to the particle 51P in the second common electrode part 61B are different from each other. In other words, the head chips 40 have the structure in which the first common electrode part 61A out of the common electrode 61 can be formed by the oblique vapor deposition from the first surface 51/1 side, and at the same time, the second common electrode part 61B can be formed by the oblique vapor deposition from the second surface 51/2 side. Since the evaporated film has a directionality in film growth, even if the film thickness is sufficiently thick, in the case in which the film is formed like islands along the particles 51P constituting the actuator plate 51, it is concerned that the appropriate film as the common electrode 61 is not achieved. Therefore, by performing the evaporation from the both surfaces to form the common electrode 61, the coatability of the common electrode 61 on the inner surface 541 of the ejection channel 54 is improved, and as a result, it is possible to achieve an improvement in continuity (the film quality) of the common electrode 61 itself. Further, due to the improvement in coatability of the common electrode 61, the variation in film thickness of the whole of the common electrode 61 in the thickness direction (the Y-axis direction) of the actuator plate 51 is reduced. Therefore, the operation of the actuator plate 51 is stabilized, and the variation in ejection speed of the ink and ejection amount of the ink is reduced.

Further, in the present embodiment, it is arranged that the actuator plate 51 further has the common electrode pads 62 which are disposed in the end part region of the second surface 51*f*2, and are coupled to the common electrodes 61. Specifically, the common electrode pads 62 electrically connected to the common electrodes 61 covering the inner surfaces 541 of the ejection channels 54 are disposed on the second surface 51*f*2 on the opposite side to the cover plate 52 for supplying the ink to the ejection channels 54. Therefore, it is easy to connect wires for supplying the voltages to the common electrode pads 62. Further, since the paths of the common electrode pads 62 to be coupled to the common electrodes 61 are simplified, it is easy to avoid occurrence of broken lines on the paths, and in addition, the length of the path from the common electrode to the common electrode pad 62 is also reduced.

Further, in the present embodiment, the end part (the closed end 54T) in the Z-axis direction in the ejection channel 54 includes the tilted surface 54*b* facing the cover plate 52 with a tilt, and includes the exposed part where the second common electrode part 61B is not formed, but the inner surface 541 or the first common electrode part 61A is exposed. Such a configuration is a trace of forming the first common electrode part 61A by the evaporation from the first surface 51*f*1 side, and at the same time forming the second common electrode part 61B by the evaporation from the second surface 51*f*2 side. As described above, since it is arranged that the first common electrode part 61A is evaporated from the first surface 51*f*1 side, and at the same time, the second common electrode part 61B is evaporated from the second surface 51*f*2 side, it is possible to homogenize each of the film quality of the first common electrode part 61A and the film quality of the second common electrode part 61B, and it is possible to suppress the degradation of the film quality as a whole in the common electrode 61.

Further, in the present embodiment, it is possible to arrange that the first common electrode part 61A has the depth H61A in the thickness direction (the Y-axis direction) of the actuator plate 51, and the second common electrode part 61B has the depth H61B smaller than the depth H61A in the thickness direction of the actuator plate 51. In that case, it is possible to make the evaporation angle to the inner surface 541 when forming the second common electrode part 61B larger than the evaporation angle to the inner surface 541 when forming the first common electrode part 61A. Therefore, when forming the second common electrode part 61B, it is possible to decrease the second common electrode part 61B (the metal coating MF2) adhering to the second surface 51*f*2 without decreasing the second common electrode part 61B (the metal coating MF2) adhering to the inner surface 541 of the ejection channel 54. Therefore, since it is possible to reduce the film thickness of the second common electrode part 61B (the metal coating MF2) adhering to the second surface 51*f*2, it is possible to shorten the time necessary to remove the unwanted part of the second common electrode part 61B (the metal coating MF2) adhering to the second surface 51*f*2.

Further, in the present embodiment, since it is arranged that the resist pattern RP2 is selectively formed on the second surface 51*f*2 so as to cover the dummy channels 55 without covering the ejection channels 54, it is possible to make the width of the mask pattern larger than in the case of forming the mask pattern to each of the drive walls 56 between the ejection channels 54 and the dummy channels 55. Therefore, it is possible to cope with a fine pitch configuration. Further, it is possible to selectively form the common electrode pads 62 to electrically be connected to the common electrodes 61 at predetermined positions of the second surface 51*f*2 of the actuator plate 51.

Further, in the head chips 40, among the three parts, namely the actuator plate 51, the cover plate 52, and the sealing plate 53, the shape of the sealing plate 53 is simplified. Therefore, since the high processing accuracy becomes unnecessary when manufacturing the sealing plate 53, it is possible to form the sealing plate 53 using a material which is difficult to process with high accuracy. In other words, the degree of freedom of selection of the constituent material is increased.

Further, in the inkjet head 4 according to the present embodiment, since it is arranged that the common flow channel plate 41 is disposed between the two head chips 40A, 40B, a part of the ink flow channel can be used in common. However, in the inkjet head described in, for example, JP-A-2007-50687, it is arranged that ink chamber plates 7, 10 including an ink chamber are disposed on the outer side of piezoelectric ceramic plates 2, 5 including grooves through which the ink flows. In other words, the flow channel of the ink for supplying the ink to the piezoelectric ceramic plate 2 and the flow channel of the ink for supplying the ink to the piezoelectric ceramic plate 5 are separated from each other. Therefore, the dimension in the stacking direction of the piezoelectric ceramic plates 2, 5 and the ink chamber plates 7, 10, namely the thickness is apt to increase. Alternatively, as the inkjet head described in the specification of U.S. Pat. No. 8,091,987, since two systems of ink flow channels become necessary also in the structure in which the ink having ejected from the ejection ends of the pair of actuator plates arranged so as to be adjacent to each other is discharged outside the pair of actuator plates, the thickness is also apt to increase. In contrast, in the inkjet head 4 according to the present embodiment, since the flow channels for supplying the ink to the two head chips 40A, 40B can be consolidated, it is possible to realize the inkjet head 4 in which a simpler structure compared to the related art is realized, the thickness in the Y-axis direction is reduced, and the weight is reduced.

The head chips 40 according to the present embodiment is arranged to be further provided with the individual electrodes 63 disposed on the inner surfaces of the dummy channels 55, and the individual electrode pads 64 disposed on the second surface 51*f*2. Therefore, by applying the drive voltage between the common electrode 61 and the individual electrode 63, it is possible to cause the thickness-shear deformation in the two drive walls 56 for defining the ejection channel 54 to introduce the ink into the ejection channel 54, and by vanishing the drive voltage between the common electrode 61 and the individual electrode 63, it is possible to restore the drive walls 56 to eject the ink from the ejection channel 54. In particular, since the actuator plate 51 is formed of the chevron substrate having the structure in which the two piezoelectric substrates 51*a*, 51 *b* on which the polarization treatment has been performed in the thickness direction are stacked on one another, it is possible to decrease the drive voltage of the actuator plate 51 compared to the case of using a monopole substrate as the actuator plate 51.

Further, in the head chips 40 according to the present embodiment, the lower end part of each of the ejection channels 54 forms the opening 54K exposed in the lower end surface 511 of the actuator plate 51, and the upper end part of each of the ejection channels 54 forms the closed end including the tilted surface 54*b* terminated within the actuator plate 51. Therefore, the ink supplied from the liquid supply channel 70 of the cover plate 52 to the ejection channel 54 is guided by the tilted surface 54*b* of the closed end so as to proceed toward the opening 54K. Therefore, since the ink can smoothly move inside the ejection channel 54, the stable ejection operation can be realized.

2. MODIFIED EXAMPLES

Then, some modified examples (Modified Examples 1 through 2) of the embodiment described above will be described. It should be noted that substantially the same constituents as those in the embodiment are denoted by the same reference symbols, and the description thereof will arbitrarily be omitted.

Modified Example 1

Figure 14:
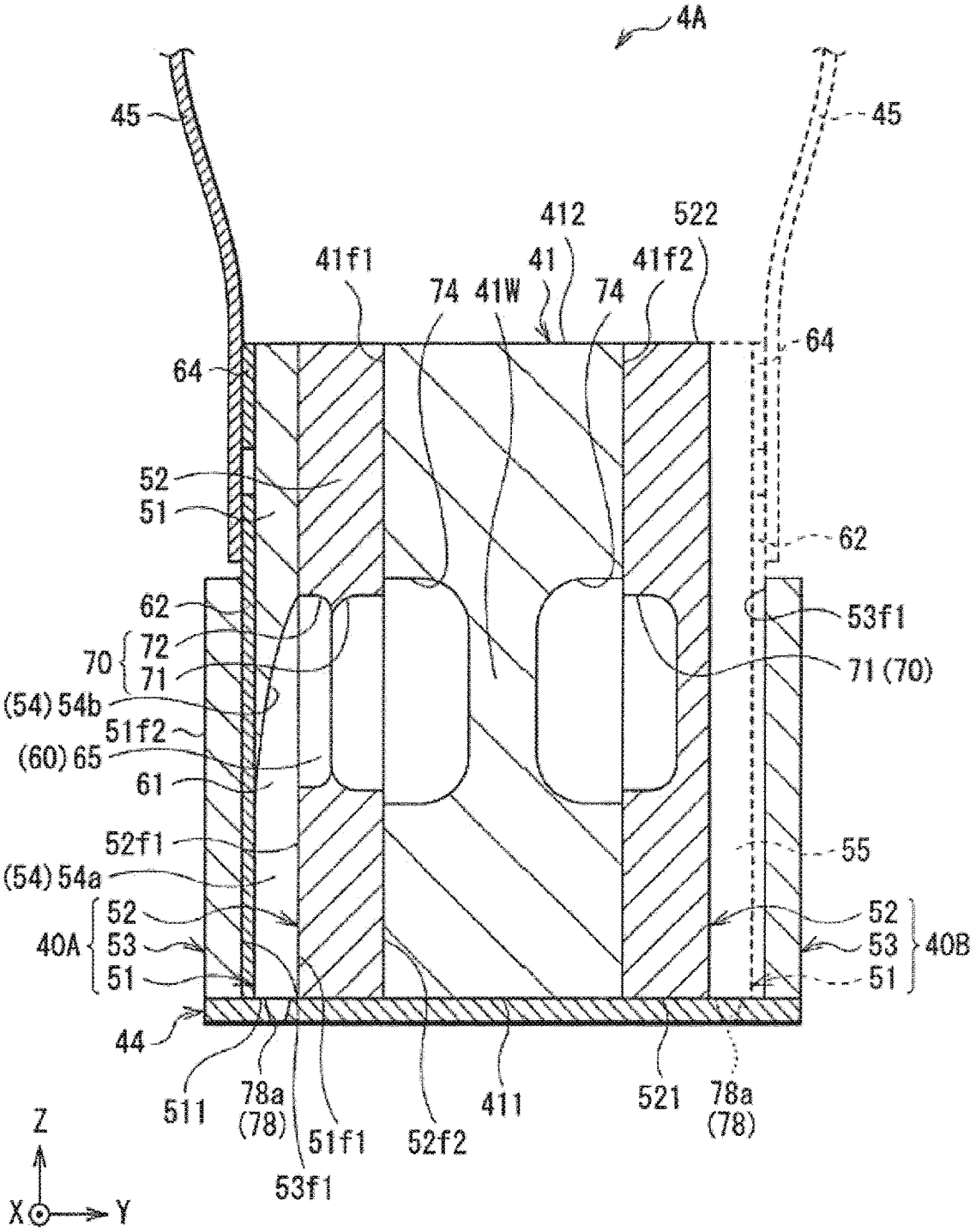
FIG. 14 is a cross-sectional view of a liquid jet head according to Modified Example 1.

FIG. 14 shows a cross-sectional surface along the extending direction of the ejection channels 54 in an inkjet head 4A according to Modified Example 1. FIG. 13 corresponds to FIG. 4 showing the inkjet head 4 according to the embodiment described above. The inkjet head 4 according to the embodiment described above has the structure in which the return plate 43 is inserted between the head chips 40 and the nozzle plate 44 to perform the ink circulation between the ink tank 3 and the inkjet head 4. In contrast, the inkjet head 4A according to Modified Example 1 shown in FIG. 13 does not have the return plate 43. Specifically, the nozzle plate 44 is bonded to the lower end surfaces 511, 521, and 531 of the head chips 40A, 40B and the lower end surface 411 of the flow channel plate 41 with an adhesive or the like. Further, the flow channel plate 41 is provided with the entrance flow channels 74, but is not provided with the exit flow channels 75. Therefore, in the inkjet head 4A, it is arranged that the ink circulation in the inside is not performed, and the ink to be ejected from the opening 54K of the ejection channel 54 proceeds toward the nozzle plate 44, and is then ejected from the nozzle 78. The inkjet head 4A according to Modified Example 1 has substantially the same configuration as that of the inkjet head 4 according to the embodiment described above in other points except the point described above, and can therefore be provided with substantially the same advantages as in the inkjet head 4 according to the embodiment described above.

Modified Example 2

Figure 15:
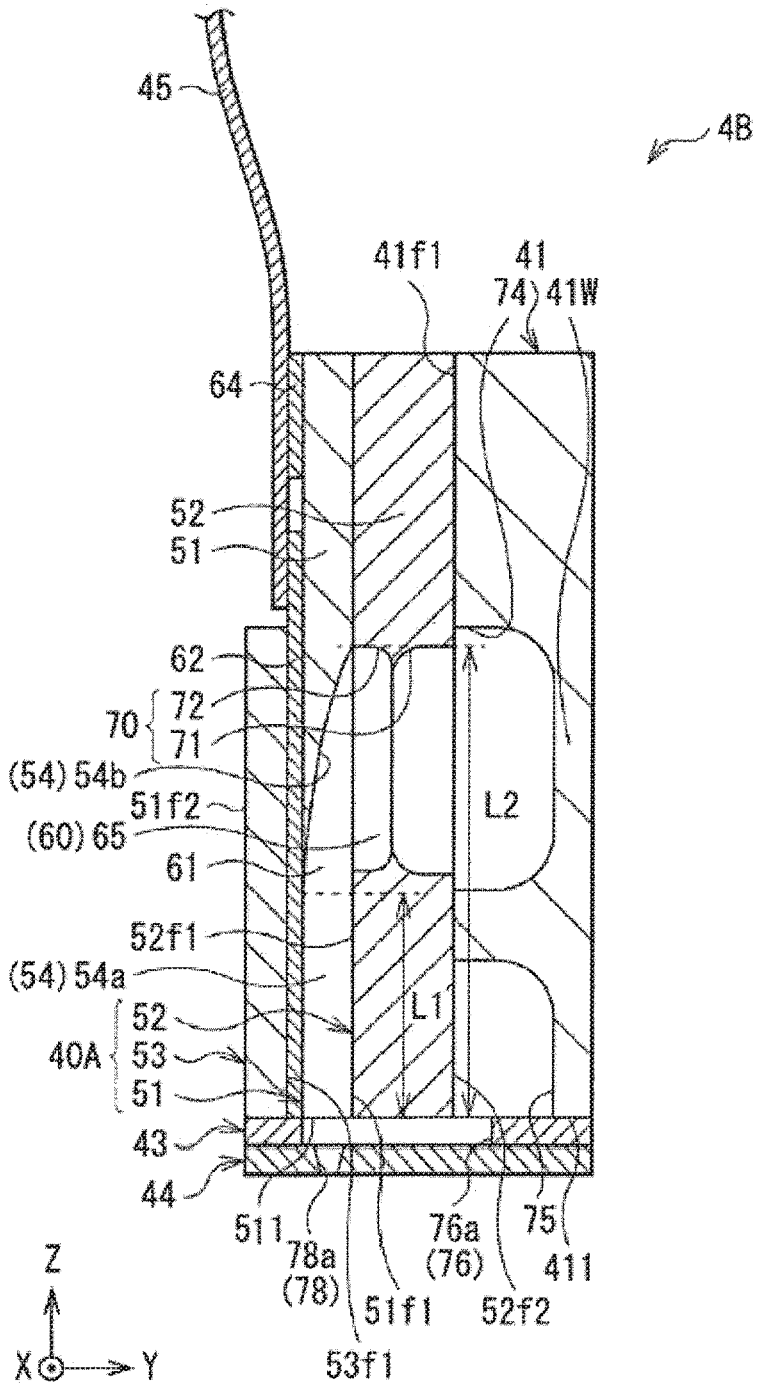
FIG. 15 is a cross-sectional view of a liquid jet head according to Modified Example 2.

FIG. 15 shows a cross-sectional surface along the extending direction of the ejection channels 54 in an inkjet head 4B according to Modified Example 2. FIG. 14 corresponds to FIG. 4 showing the inkjet head 4 according to the embodiment described above. The inkjet head 4 according to the embodiment described above has the structure in which the head chip 40A and the head chip 40B are disposed on both sides of one flow channel plate 41. In contrast, the inkjet head 4B according to Modified Example 2 shown in FIG. 14 has a structure in which the head chip 40 is disposed only on one side of one flow channel plate 41B. The inkjet head 4B according to Modified Example 2 has substantially the same configuration as that of the inkjet head 4 according to the embodiment described above in other points than the point described above.

3. OTHER MODIFIED EXAMPLES

The present disclosure is described hereinabove citing the embodiment and some modified examples, but the present disclosure is not limited to the embodiment and so on, and a variety of modifications can be adopted.

For example, in the embodiment described above, the description is presented specifically citing the configuration examples (the shapes, the arrangements, the number and so on) of each of the members in the printer, the inkjet head, and the head chip, but those described in the above embodiment and so on are not limitations, and it is possible to adopt other shapes, arrangements, numbers and so on.

In the embodiment and so on described above, the description is presented illustrating the so-called edge-shoot type inkjet head for ejecting the ink from the ejection end (the opening 54K) as an end part in the extending direction of the ejection channels, but the liquid jet head according to the present disclosure is not limited to the illustration. Specifically, it is also possible to adopt a so-called side-shoot type inkjet head in which the ink passes in the thickness direction of the actuator plate, namely the depth direction of the ejection channels.

Further, the method of forming the liquid jet head chip according to the present disclosure is not limited to the procedure explained in the embodiment described above. For example, after the processes shown in FIG. 9A through FIG. 9E, it is also possible to form the metal coatings MF2 and the metal coatings MF3 in a lump as described below. Specifically, as shown in FIG. 9E, the grinding work is performed on the piezoelectric wafer 51*b*Z from the reverse surface to expose the plurality of ejection channels 54 and the plurality of dummy channels 55. Then, unlike the resist pattern RP2 shown in FIG. 9G, the resist pattern is selectively formed on the second surface 51*f*2 so as not to close the plurality of dummy channels 55. Specifically, the resist pattern is selectively formed on the second surface 51*f*2 of the parts where the ejection channels 54 or the dummy channels 55 are not formed out of the piezoelectric substrate 51*b*, namely the parts eventually turn to the drive walls 56, in the piezoelectric substrate 51*b*. Subsequently, the metal coatings MF2 covering the inner surfaces 541 of the plurality of the ejection channels 54 and the inner surfaces 551 of the plurality of dummy channels 55, and the metal coatings MF3 covering the second surface 51*f*2 and the resist pattern using, for example, an evaporation method in a lump. Subsequently, the resist pattern is removed. As a result, there remain only the parts covering the inner surfaces 541 of the ejection channels 54 or the inner surfaces 551 of the dummy channels 55 out of the metal coatings MF2, and thus, the common electrodes 61 and the individual electrodes 63 are formed. In addition, some parts of the metal coatings MF3 remain in the second surface 51*f*2 to form the common electrode pads 62 and the individual electrode pads 64.

Further, in the embodiment and so on described above, there is illustrated the chevron type actuator plate in which the two piezoelectric substrates having the respective polarization directions different from each other are stacked on one another, but it is also possible for the inkjet head according to the present disclosure to be an inkjet head having a so-called cantilever type (monopole type) actuator plate. The cantilever type (the monopole type) actuator plate is formed of a single piezoelectric substrate having the polarization direction set to one direction along the thickness direction. It should be noted that in the cantilever type (the monopole type) actuator plate, for example, the drive electrode is attached to the upper half in the depth direction with the oblique vapor deposition. Therefore, by the drive force acting only on the part provided with the drive electrode, the drive walls make the flexural deformation. As a result, even in this case, since the drive walls make the flexural deformation to have the V-shape, it results in that the ejection channel deforms as if the ejection channel bulges.

Further, in the embodiment and so on described above, the description is presented citing the printer 1 (the inkjet printer) as a specific example of the "liquid jet recording device" in the present disclosure, but this example is not a limitation, and it is also possible to apply the present disclosure to other devices than the inkjet printer. In other words, it is also possible to arrange that the "head chip" (the head chips 40A, 40B) and the "liquid jet head" (the inkjet head 4) of the present disclosure are applied to other devices than the inkjet printer. Specifically, it is also possible to arrange that the "head chip" and the "liquid jet head" of the present disclosure are applied to a device such as a facsimile or an on-demand printer.

It should be noted that the advantages described in the specification are illustrative only but are not a limitation, and other advantages can also be provided.

Further, the present disclosure can also take the following configurations.

<1>

A liquid jet head chip comprising an actuator plate having an obverse surface, a reverse surface, and two or more ejection channels which penetrate the actuator plate in a thickness direction from the obverse surface toward the reverse surface, which are disposed so as to be adjacent to each other at intervals in a first direction perpendicular to the thickness direction and which are disposed so as to extend in a second direction perpendicular to both of the thickness direction and the first direction; and an electrode disposed on an inner surface of the ejection channel, wherein the electrode includes a first electrode part covering the inner surface of the ejection channel continuously from the obverse surface toward the reverse surface; and a second electrode part covering the inner surface of the ejection channel continuously from the reverse surface toward the obverse surface, and overlapping at least a part of the first electrode part.

<2>

The liquid jet head chip according to <1>, wherein the first electrode part includes a part where a film thickness decreases in a direction from the obverse surface toward the reverse surface, and the second electrode part includes a part where a film thickness decreases in a direction from the reverse surface toward the obverse surface.

<3>

The liquid jet head chip according to <1> or <2>, wherein the first electrode part and the second electrode part include first metal covering the inner surface of the ejection channel, and second metal covering the first metal.

<4>

The liquid jet head chip according to <3>, wherein the actuator plate has a plurality of particles sintered, and a first stacking direction of the first metal and the second metal with respect to the plurality of particles in the first electrode part, and a second stacking direction of the first metal and the second metal with respect to the plurality of particles in the second electrode part are different from each other.

<5>

The liquid jet head chip according to <1>, wherein the actuator plate further includes an electrode pad disposed in an end part region of the reverse surface, and electrically coupled to the electrode.

<6>

The liquid jet head chip according to any one of <1> to <5>, further comprising a cover plate which is disposed so as to be opposed to the obverse surface of the actuator plate, and has a liquid flow hole opposed to the ejection channel, wherein an end part in the second direction in the ejection channel includes a tilted surface facing the cover plate with a tilt, and the end part in the ejection channel includes an exposed part where the second electrode part fails to be formed, and one of the inner surface and the first electrode part is exposed.

<7>

The liquid jet head chip according to <1>, further comprising a sealing plate which is disposed so as to be opposed to a channel formation region other than the end part region out of the reverse surface of the actuator plate, and closes the ejection channels.

<8>

The liquid jet head chip according to <5>, wherein the first electrode part has a first depth dimension in the thickness direction, and the second electrode part has a second depth dimension smaller than the first depth dimension in the depth direction.

<9>

A liquid jet head comprising the liquid jet head chip according to any one of <1> to <8>.

<10>

The liquid jet head according to <9>, further comprising a return plate, wherein the ejection channel further includes an ejection end exposed in a front end surface crossing the reverse surface out of the actuator plate, and a closed end located between a back end surface on an opposite side to the front end surface out of the actuator plate and the front end surface, and the return plate is disposed so as to cover the front end surface of the actuator plate, and includes a circulation channel communicated with the ejection channel.

<11>

A liquid jet recording device comprising the liquid jet head according to <9> or <10>; and a base to which the liquid jet head is attached.

<12>

A method of forming a liquid jet head chip comprising providing an actuator plate having an obverse surface, a reverse surface, and two or more ejection channels which are dug down to an intermediate position from the obverse surface to the reverse surface in the thickness direction perpendicular to the obverse surface and the reverse surface, which are disposed so as to be adjacent to each other at intervals in a first direction perpendicular to the thickness direction and which are disposed so as to extend in a second direction perpendicular to both of the thickness direction and the first direction; evaporating a first electrode part on an inner surface of the ejection channel from the obverse surface side; exposing the ejection channels on the reverse surface by grinding the actuator plate from the reverse surface side in the thickness direction; and evaporating a second electrode part on the inner surface of the ejection channel exposed on the reverse surface from the reverse surface side so as to partially overlap the first electrode part, to thereby form an electrode including the first electrode part and the second electrode part.

<13>

The method of forming the liquid jet head chip according to <12>, wherein the actuator plate further includes two or more non-ejection channels respectively adjacent to the two or more ejection channels in the first direction and disposed so as to extend in the second direction, when evaporating the first electrode part on the inner surface of the ejection channel from the obverse surface side, the first electrode part is also evaporated on an inner surface of the non-ejection channel from the obverse surface side, when grinding the actuator plate from the reverse surface in the thickness direction, the non-ejection channels are also exposed on the reverse surface together with the ejection channels, by evaporating the second electrode part on the inner surface of the ejection channel exposed on the reverse surface, a common electrode corresponding to the electrode including the first electrode part and the second electrode part is formed, and by evaporating the second electrode part also on the inner surface of the non-ejection channel from the reverse surface side so as to partially overlap the first electrode part, an individual electrode including the first electrode part and the second electrode part is formed on the inner surface of the non-ejection channel, and a common electrode pad and a wiring pattern connecting the common electrode pad and the common electrode to each other are formed by forming the common electrode and the individual electrode, and then selectively forming a mask pattern on the reverse surface so as to cover the non-ejection channel without covering the ejection channels; forming an electrically conductive film so as to entirely cover the mask pattern and the reverse surface; and removing the mask pattern.

<14>

The method of forming the liquid jet head chip according to <12> or <13>, comprising forming the first electrode part at a first evaporation angle with respect to the inner surface of the ejection channel; and forming the second electrode part at a second evaporation angle larger than the first evaporation angle with respect to the inner surface of the ejection channel.

What is claimed is:

1. A liquid jet head chip comprising:

an actuator plate having an obverse surface, a reverse surface, and two or more ejection channels which penetrate the actuator plate in a thickness direction from the obverse surface toward the reverse surface, which are disposed so as to be adjacent to each other at intervals in a first direction perpendicular to the thickness direction and which are disposed so as to extend in a second direction perpendicular to both of the thickness direction and the first direction; and an electrode disposed on an inner surface of the ejection channel, wherein the electrode includes:

a first electrode part covering the inner surface of the ejection channel continuously from the obverse surface toward the reverse surface; and a second electrode part covering the inner surface of the ejection channel continuously from the reverse surface toward the obverse surface, and overlapping at least a part of the first electrode part, wherein the first and second electrode parts overlap along the length of the ejection channel to form a common electrode.

2. The liquid jet head chip according to claim 1, wherein the first electrode part includes a part where a film thickness decreases in a direction from the obverse surface toward the reverse surface, and the second electrode part includes a part where a film thickness decreases in a direction from the reverse surface toward the obverse surface.

3. The liquid jet head chip according to claim 1, wherein the first electrode part and the second electrode part include first metal covering the inner surface of the ejection channel, and second metal covering the first metal.

4. The liquid jet head chip according to claim 3, wherein the actuator plate has a plurality of particles sintered, and a first stacking direction of the first metal and the second metal with respect to the plurality of particles in the first electrode part, and a second stacking direction of the first metal and the second metal with respect to the plurality of particles in the second electrode part are different from each other.

5. The liquid jet head chip according to claim 1, wherein the actuator plate further includes an electrode pad disposed in an end part region of the reverse surface, and electrically coupled to the electrode.

6. The liquid jet head chip according to claim 1, further comprising a cover plate which is disposed so as to be opposed to the obverse surface of the actuator plate, and has a liquid flow hole opposed to the ejection channel, wherein an end part in the second direction in the ejection channel includes a tilted surface facing the cover plate with a tilt, and the end part in the ejection channel includes an exposed part where the second electrode part fails to be formed, and one of the inner surface and the first electrode part is exposed.

7. The liquid jet head chip according to claim 1, further comprising a sealing plate which is disposed so as to be opposed to a channel formation region other than the end part region out of the reverse surface of the actuator plate, and closes the ejection channels.

8. The liquid jet head chip according to claim 5, wherein the first electrode part has a first depth dimension in the thickness direction, and the second electrode part has a second depth dimension smaller than the first depth dimension in the depth direction.

9. A liquid jet head comprising the liquid jet head chip according to claim 1.

10. The liquid jet head according to claim 9, further comprising a return plate, wherein the ejection channel further includes an ejection end exposed in a front end surface crossing the reverse surface out of the actuator plate, and a closed end located between a back end surface on an opposite side to the front end surface out of the actuator plate and the front end surface, and the return plate is disposed so as to cover the front end surface of the actuator plate, and includes a circulation channel communicated with the ejection channel.

11. A liquid jet recording device comprising:

the liquid jet head according to claim 9; and a base to which the liquid jet head is attached.

12. A method of forming a liquid jet head chip comprising:

providing an actuator plate having an obverse surface, a reverse surface, and two or more ejection channels which are dug down to an intermediate position from the obverse surface to the reverse surface in the thickness direction perpendicular to the obverse surface and the reverse surface, which are disposed so as to be adjacent to each other at intervals in a first direction perpendicular to the thickness direction and which are disposed so as to extend in a second direction perpendicular to both of the thickness direction and the first direction;

evaporating a first electrode part on an inner surface of the ejection channel from the obverse surface side;

exposing the ejection channels on the reverse surface by grinding the actuator plate from the reverse surface side in the thickness direction; and evaporating a second electrode part on the inner surface of the ejection channel exposed on the reverse surface from the reverse surface side so as to partially overlap the first electrode part along the length of the ejection channel, to thereby form a common electrode including the first electrode part and the second electrode part.

13. The method of forming the liquid jet head chip according to claim 12, wherein the actuator plate further includes two or more non-ejection channels respectively adjacent to the two or more ejection channels in the first direction and disposed so as to extend in the second direction, when evaporating the first electrode part on the inner surface of the ejection channel from the obverse surface side, the first electrode part is also evaporated on an inner surface of the non-ejection channel from the obverse surface side, when grinding the actuator plate from the reverse surface in the thickness direction, the non-ejection channels are also exposed on the reverse surface together with the ejection channels, by evaporating the second electrode part on the inner surface of the ejection channel exposed on the reverse surface, a common electrode corresponding to the electrode including the first electrode part and the second electrode part is formed, and by evaporating the second electrode part also on the inner surface of the non-ejection channel from the reverse surface side so as to partially overlap the first electrode part, an individual electrode including the first electrode part and the second electrode part is formed on the inner surface of the non-ejection channel, and a common electrode pad and a wiring pattern connecting the common electrode pad and the common electrode to each other are formed by:

forming the common electrode and the individual electrode, and then selectively forming a mask pattern on the reverse surface so as to cover the non-ejection channel without covering the ejection channels;

forming an electrically conductive film so as to entirely cover the mask pattern and the reverse surface; and removing the mask pattern.

14. The method of forming the liquid jet head chip according to claim 12, comprising:

forming the first electrode part at a first evaporation angle with respect to the inner surface of the ejection channel; and forming the second electrode part at a second evaporation angle larger than the first evaporation angle with respect to the inner surface of the ejection channel.

* * * * *